US006482062B1

(12) United States Patent
Yao et al.

(10) Patent No.: US 6,482,062 B1
(45) Date of Patent: Nov. 19, 2002

(54) METHOD OF FORMING BARRIER RIB AND DISCHARGE CELL FOR PLASMA DISPLAY PANEL

(75) Inventors: Yasunori Yao; Akihiro Kanezawa; Nobuya Yamazaki; Takashi Utsumi; Tooru Kubo, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/506,833

(22) Filed: Feb. 18, 2000

(30) Foreign Application Priority Data

Feb. 18, 1999 (JP) ..... 11-039938
Feb. 24, 1999 (JP) ..... 11-046366
Mar. 1, 1999 (JP) ..... 11-053014

(51) Int. Cl.[7] ..... H01J 9/24
(52) U.S. Cl. ..... 445/24; 313/582
(58) Field of Search ..... 445/24; 313/582

(56) References Cited

U.S. PATENT DOCUMENTS 5,853,446 A 12/1998 Carre et al.

6,199,404 B1 * 3/2001 Kawai et al. ..... 65/102

* cited by examiner

*Primary Examiner*—Kenneth J. Ramsey
(74) *Attorney, Agent, or Firm*—Birch, Stewart, Kolasch & Birch, LLP

(57) ABSTRACT

A method of forming barrier ribs for a plasma display panel comprising the steps of: forming an uncured barrier rib material layer on a glass substrates; rolling on said barrier rib material layer a roller having an intaglio recessed pattern corresponding to a desired pattern for the barrier ribs to be formed, so that the freestanding structures of the rib material corresponding to the barrier ribs; and drying and firing the barrier rib material shaped into the freestanding structures, whereby the barrier ribs for partitioning discharge cells are formed on the glass substrate. A phosphor can be filled in the discharge cells by rolling a roller having groove or recessed pattern corresponding the barrier rib pattern on the phosphor material laminated on the substrate. A phosphor material sheet used to form discharge cells on the substrate and manufacturing method thereof are also provided.

73 Claims, 27 Drawing Sheets

METHOD OF FORMING BARRIER RIB AND DISCHARGE CELL FOR PLASMA DISPLAY PANEL

BACKGROUND OF THE INVENTION

1. Field of the Invention

The present invention relates to a plasma display panel (hereinafter referred to as a "PDP") and a method of forming barrier ribs (partition walls) for the same. More particularly, the invention relates to a method of forming barrier ribs for the PDP that is suitable for a high-definition color display apparatus having a reduced thickness and larger display area. The present invention also relates to a method of forming discharge cells for a plasma display panel. Further, the present invention relates to a phosphor material sheet which is used in the method of forming the discharge cells in the plasma display panel and relates to manufacturing method thereof.

2. Description of the Related Art

A PDP is a display device which serves as flat panel display in large and high-definition color display. The general construction of the PDP includes front and rear glass substrates facing each other with minute spacing and peripherally sealed. Pairs of electrodes are regularly arranged on these two glass substrates, respectively, and a discharge gas mixture containing Ne as a main component is hermetically sealed in the space defined by the two substrates. On the rear glass substrate, a large number of small discharge spaces called discharge cells are formed by line barrier ribs (partition walls). A phosphor is applied to the internal side of each discharge cell. On the opposite front substrate, electrodes facing the discharge cell are provided. By applying a suitable voltage between electrodes, the plasma discharge is induced locally in the discharge gas. ultraviolet ray generated by the plasma discharge induces luminescence of the neighboring phosphors. That is, the discharge cells are used as light emitting elements of the display.

As a method of manufacturing the barrier ribs (partition walls) forming the discharge cells of the PDP, a print laminating method and a sandblasting method are generally known. According to the print laminating method, a the barrier ribs are formed by repeating a step of printing a glass paste onto the rear glass substrate by a screen printing method and drying it until the paste has a height which is required for the barrier rib.

According to the sandblasting method, a thick film made of a barrier rib material (glass paste) is formed on the rear substrate, a subtractive resist. pattern is formed on the thick film by lithography, and the barrier rib material exposed in opening portions of the resist is removed by sandblasting (spraying fine particles mixed into a compressed air at a high speed to physically etch). The resist pattern is removed after the formation of the barrier ribs.

The barrier rib pattern formed by such various methods is fired at a high temperature to form glass barrier ribs. A phosphor material layer (thickness is 20 to 30 $\mu$m) is formed in each discharge cell in the next phosphor forming step. The formation of the phosphor material layer employs the screen printing method so far. According to the conventional screen printing method, a phosphor material paste obtained by mixing and kneading a phosphor, an organic binder, a solvent, and the like is supplied to the internal wall of each discharge cell partitioned by the fired barrier ribs.

It is a matter of course that the phosphor material paste of a color corresponding to the color of the pixel of the PDP is supplied to the corresponding discharge cell. Each of R (red), G (green), and B (blue) phosphor material pastes is applied to the inside of-the corresponding discharge cells by the different screen printing step. Namely, there is required to conduct three times printing steps in total in order to supply three different color phosphor material pastes to the corresponding discharge cells.

A technique of photolithography employing photosensitive phosphor material pastes is also examined in place of the screen printing method. According to the method, R/G, and B phosphor material pastes are sequentially applied and procedures such as exposure, development, cleaning, and the like are repeated every phosphor material paste.

The conventional methods of forming the barrier ribs have the following problems. First in the print laminating method, since the thickness of the rib material layer which can be formed in one printing operation is tens of $\mu$m at maximum, in order to obtain a height of 100 to 200 $\mu$m required for the barrier ribs, it is necessary to repeat printing and drying a large number of times, generally, about ten times. Consequently, there is a problem that the productivity is remarkably low. In an addition, the rib material layer formed by the screen printing has a declined peripheral portion and the raised center portion. When the layers are stacked by printing many times over, the peripheral portions in a sagging form in section are accumulated, so that the bottom of the barrier rib is widened. Consequently, the realization of a high density formation of the barrier ribs is restricted. Further, pitch precision is also limited because of distortion or life of a screen (printing plate), so that it is difficult to realize the large size, high definition, and mass production of the PDP.

As for the sandblasting method, the procedures of formation, elimination, and the like of the resist pattern are complicated. Particularly, when the large-sized display is realized, the scale of an exposing apparatus or a sandblasting apparatus is enormously enlarged, resulting in a sharp increase in cost of equipment. Further, the loss of a material due to sandblast etching is large. Consequently, there is a problem that the manufacturing cost is increased.

Both of the print laminating method and the sandblasting method have the common problem that the shape of the uncured barrier rib is easily deformed due to shrinkage upon firing in a post process. Generally, the shrinkage upon firing can be reduced at a certain degree by raising the content of glass powders contained in the barrier rib material. In this case, however, the flowability of the barrier rib material is contrarily deteriorated. Consequently, it becomes hard to form the fine structures of the barrier ribs, so that there is a problem that formability of the uncured freestanding structures which will be fired to Dorm the barrier ribs, namely, fidelity of the finished barrier ribs is deteriorated.

In order to solve the above-mentioned problems existing in the conventional print laminating method and sandblasting method, it is considered to use a pressure molding method of pressurizing a plane mold onto a thick film made of a barrier rib material formed on a substrate. Also it is considered that a method of photolithography widely used for formation of a-thin film pattern is used for forming the barrier ribs.

The pressure molding method employing the plane mold is excellent because it solves the problems of the printing method and the sandblasting method. Fundamentally, however, the method has a problem that the glass paste is easily partially peeled off from the substrate when the plane mold is separated from the substrate. Therefore, various means for raising adhesive properties of the glass paste to the glass substrate are needed. Selection of the material is restricted and addition of a new process is required. It is difficult to manufacture a large-sized precision mold corresponding to the large size of the substrate, so that a stupendous increase in cost of the apparatus is also conceived as a problem.

The photolithography method employs a photosensitive glass paste and has characteristics such that a precise pattern of barrier ribs can be realized at a high resolution. According to the method, however, processes such as coating/drying of a photo resist, exposure by ultraviolet rays, development, cleaning, and drying are complicated and it takes much time. Surplus materials such as photo resist and developer are required. Expensive apparatuses having a large floor area such as exposing apparatus, developing apparatus, and cleaning apparatus are also needed. Further, the photosensitive glass paste must have larger proportion of resin to glass, as compared with a non-photosensitive glass paste. This causes problems that a degree of shrinkage of the barrier rib structures upon firing is raised, the loss of the material is large, and the like. consequently, it causes an increase in cost.

The conventional method of coating a phosphor material paste has the following problems. As for the method of coating the phosphor material paste by the screen printing method, since the phosphor material paste supplied to the discharge cell is adhered to the rib internal wall by using its material properties, the uniformity of the film thickness of the phosphor is not always guaranteed, so that it is difficult to manage the film thickness. From the viewpoints of life of a screen mask which is used for the screen printing, operating performance, handling such as cleaning, there is a problem that the method is not suitable for mass production of the high-definition large-sized PDP.

In the method of coating the phosphor by the photolithography technique, there is required to conduct complicated procedures such as exposure, development, cleaning, and the like. Since two-thirds of the respective color phosphor material pastes applied on the whole surface of the glass substrate is removed by developing process, the efficiency of utilization of the phosphor material paste is deteriorated. In addition, since the removed phosphor material paste is expensive, it is necessary to recover it. Further, the glass substrate has an uneven surface because the barrier rib pattern is formed. Accordingly, it is not easy to remove the phosphor material paste after exposure. Also, the remaining phosphor material paste tends to be contaminated to other color phosphor material pastes. This causes a problem that the mixture of colors easily occurs.

Further, according to the conventional methods, firing for the barrier rib formation and firing after coating the phosphor material pastes, namely, the firing of two times in total is needed. Since the firing process involves heating and cooling, it requires the longest processing time in the whole procedure. Because the firing process must be performed twice, the whole processing time is remarkably extended and the productivity is deteriorated. This also causes an increase in manufacturing cost.

SUMMARY OF THE INVENTION

The present invention is accomplished in consideration of the aforementioned circumstances, and a first object thereof is to provide a method of forming barrier ribs of a PDP, wherein barrier ribs for forming discharge cells of the PDP can be formed with high precision, it is suitable for realizing a high-definition and a large size of the PDP, a process is simplified to realize small size and scale of a manufacturing apparatus, occurrence of the loss of a material is prevented, a yield is improved, and a manufacturing cost can be reduced.

A second object of the present invention is to provide method of forming discharge cells of a PDP, wherein barrier ribs partitioning discharge cells in the PDP and a phosphor material layer in the discharge cell can be formed with high precision, it is suitable for realizing a high-definition and a large size of the PDP, a process is simplified to realize small size and scale of a manufacturing apparatus, occurrence of the loss of a material is prevented, a yield is improved, and a manufacturing cost can be reduced.

A third object of the present invention is to provide a sheet made of phosphor materials which is used to form discharge cells for a PDP. Further, it is a fourth object to provide a method of manufacturing the sheet.

According to the present invention, the first object can be attained by a method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) rolling a roller, which has an intaglio recessed pattern corresponding to a desired pattern for the barrier ribs on said barrier rib material layer so that the recessed pattern contacts and embosses the barrier rib material layer to form freestanding structures corresponding to the recessed pattern; and (c) drying and firing a barrier rib material shaped into the freestanding structures, whereby the barrier ribs for partitioning discharge cells are formed on the glass substrate.

In the present invention, the roller having an intaglio recessed pattern corresponding to a desired pattern of the barrier ribs to be formed is used. The intaglio recessed pattern is a recessed and embossed pattern (such as groove pattern) shaped by reversing recessed and embossed portions of the barrier rib structures to be formed. The roller is come into contact with the barrier rib material with pressure while being rotated, so that: freestanding structures of the rib material are formed on the glass substrate by single step operation. The freestanding structures, i.e., uncured barrier ribs (also referred to as "pre-ribs" hereinafter) can be converted to barrier ribs by firing.

As a barrier rib material, a material obtained by adding an additive such as alumina, tin oxide, titanium oxide, or zirconium oxide to a glass paste to satisfy required characteristics for barrier rib formation may be used. As for the PDP to which the present barrier ribs forming method can be adopted, there are PDPs of various types such as alternating current surface discharge type, direct current discharge type, and hybrid type. According to the method of the present invention, the intaglio embossed and recessed pattern formed on the roller can form a proper-rib structures such as ribs parallel with stripe-shaped electrodes, ribs. perpendicular to the electrodes, or lattice-shaped (criss-crossing) ribs, which corresponds to the type of the PDP.

It is preferable to apply a release agent to the top surface of the barrier rib material layer in order to improve the release properties to the roller. A talc powder, a powder of a Teflon-based additive, a paste containing the powder, and spray liquid made by dispersing the powder in oil are suitable to the release agent. It is applied thin by a spray or a roll coater. It is preferable that the barrier rib material layer is exposed to or left in the atmosphere of its solvent vapor for a predetermined period of time to be softened, adjusted to have an optimum hardness, and then rolled by the roller. The release agent can be applied after softening in the solvent vapor.

As for the solvent which is used in the softening process, a solvent that is compatible with a resin binder contained in the glass paste may be used. For example, an aromatic solvent such as toluene or higher alcohol may be used. In case of applying the release agent, it is desirable to perform the softening process of the glass paste employing the solvent vapor before coating of the release agent in order to uniformly soften the paste. When the release agent has a nature for allowing the solvent to pass therethrough, the softening process may also be performed after such a release agent is applied.

It is convenient that the barrier rib material layer is formed by laminating a glass paste for rib, which has been previously prepared in a sheet shape, on the glass substrate. Also, the barrier rib material layer can be formed by directly applying a liquid glass paste for rib and drying it. It is desirable to use a white glass paste for rib in this case. The white barrier ribs reflects light emitted in the discharge cells to introduce the-light to the front side of the PDP, so that the efficiency of utilization of light is improved.

Although the barrier ribs are generally formed on the rear glass substrate (back plate) of the PDP, in the case where the ribs are formed on the front glass substrate depending on the type of the PDP, the method of the present invention is applicable to the front glass substrate (front plate) of the PDP. Since the barrier ribs can be formed in various forms such as stripe and lattice, it is a matter of course that the groove pattern on the surface of the roller is made to correspond to the form. For example, when the stripe-shaped ribs should be formed, annular grooves are formed on the roller and, when the lattice-shaped ribs should be formed, lattice-shaped grooves are formed on the roller.

It is necessary to move the peripheral surface of the roller and the glass substrate at the same speed without sliding at a contact portion therebetween. For this purpose, both of them are made to relatively move linearly in such manner that the peripheral velocity of the roller is being allowed to coincide with the relative linear moving speed of the glass substrate to the roller. Although the roller may be relatively moved in one direction only once, it may also be reciprocatingly moved on the same path (passage) plural times. Passing the same path of plural times in this manner enables the grooves to be gradually formed deeply on the rib material layer, so that it is possible to prevent the rib material from adhering to the roller and peeling from the glass substrate.

It is preferable to set the pressing force of the roller to the glass substrate to 20 to 200 kg/cm when the contact width of the roller in the axial direction is set as a reference. The pressing force should be changed depending on conditions such as diameter of the roller, namely, radius of curvature, or hardness of the rib material layer. When the pressing force is smaller than 20 kg/cm, the embossed or protruding portions of the intaglio recessed pattern on the roller cannot be allowed to enter the rib material layer deeply enough, so that it is difficult to obtain enough height of the barrier rib. When it is larger than 200 kg/cm, the shaft of the roller is bent and a difference between the pressing force on a position near the center of the roller in the width direction and one on both the sides increases, so that it is difficult to form reliable barrier ribs with a uniform height or thickness.

The diameter of the roller of 30 to 500 mm is suitable. When the diameter is smaller than 30 mm, the roller is easily bent. When it is larger than 500 mm, the contact area of the roller to the rib material layer is enlarged and the contact portion approximates to the face contact, so that the rib material remains in the grooves of the roller to be easily peeled off from the glass substrate.

It is preferable to set the relative linear moving speed of the glass substrate to the roller to be equivalent to the relative peripheral velocity of the roller to the glass substrate. It is preferably set to 0.02 to 2.0 m/min. When the moving speed is set less than 0.02 m/min, the productivity is remarkably deteriorated. When it is set more than 2.0 m/min, the rib material tends to be easily peeled off from the glass substrate, and therefore, the grooves having sufficient depth cannot be provided on the roller and the rib with sufficient height cannot be formed.

The grooves formed on the roller, namely, annular parallel grooves or lattice-formed (criss-crossing) grooves should be shaped into such a form that it is easily released from the rib material layer. For example, the form in section of the groove perpendicular to the longitudinal direction is shaped into a trapezoid having wide opening or a trapezoid having curved sides. That is, when it is assumed that the opening width of the groove is set to $W_T$, bottom width is set to $W_S$, depth is set to H, and pitch (pitch in the width direction of the groove) is set to $L_P$, it is preferable to form the grooves so as to satisfy the following expressions.

$$0<W_B/W_T<1.0$$

$$0.1<H/W_T<3.0$$

$$0.1<(W_T+W_B)/2L_P<1.0$$

The first object of the present invention can also be attained by a method of forming barrier ribs for a plasma display panel having a plurality of discharge cells. intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) forming on said barrier rib material layer a black mask having a pattern corresponding to a desired pattern of the barrier ribs to be formed;

(c) rolling a roller, which has grooves corresponding to the desired pattern of the barrier ribs, on said barrier rib material layer while maintaining each groove to be positioned between the black masks so that a protruding portion between the grooves contacts and embosses the barrier rib material layer to form freestanding structures having the black mask on the top thereof; and (d) drying and firing the barrier rib material shaped into the freestanding structure to form the barrier ribs having the black mask on the top thereof.

In this case, the black mask can be simultaneously formed on the top face of each barrier rib in the barrier rib forming step. Consequently, the separate or independent process for the black mask formation is not required. Of course, it is not needed to form the black mask on the front glass plate, separately.

The black mask may be formed on the rib material layer so as to correspond to the stripe-shaped or lattice-shaped rib pattern by a screen printing. In place of the screen printing, a sheet-shaped material comprised of a white rib material and a black rib material superposed thereon at the positions of the ribs can be laminated on the rib material layer.

Further, the first object of the present invention can be attained by a method of forming barrier ribs for a plasma display panel having a plurality of discharge cells intervening between a pair of glass substrates formed with electrodes, the discharged cells being partitioned by the barrier ribs, said method comprising the steps of:

(a) forming an uncured barrier rib material layer having flexibility on the surface of at least one of said glass substrates, on which said electrodes are formed;

(b) uniformly coating the surface of said barrier rib material layer with a photosensitive black rib material;

(c) rolling a roller, which has an intaglio recessed pattern corresponding to a desired pattern for the barrier ribs, on said barrier rib material layer coated with said photosensitive black rib material so that the recessed pattern forms freestanding structures corresponding the barrier ribs on the glass substrate;

(d) partially removing the black rib material so as to leave it on the upper surfaces alone of the freestanding structures by a technique of photolithography; and (e) drying and firing a barrier rib material with the black rib material shaped into the freestanding structures to form the barrier ribs.

As for the rolling roller which is used for the barrier rib formation, a roller constructed by alternately adhering and fixing two kinds of discs having different outer diameters in the axial direction can be used. In this case, chamfering the outer rim of each disc having a large diameter enables the form of the annular groove in section to be shaped into a trapezoidal form or a trapezoidal form having curved lines. When a large number of notches are formed in each large disc, the lattice-shaped ribs can be formed.

The second object of the present invention is accomplished by a method of forming discharge cells for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) rolling a rib forming roller, which has an intaglio recessed pattern corresponding-to a desired pattern for the barrier ribs to be formed, on said barrier rib material layer while the peripheral velocity of the rib forming roller is made to coincide with the relative linear moving speed of the glass substrate, so that the recessed pattern embosses the barrier rib material layer to form freestanding structures corresponding to the barrier ribs on the glass substrate;

(c) drying and firing a barrier rib material shaped into the freestanding structures to form the barrier ribs;

(d) laminating a phosphor material sheet, which is formed by uniformly applying a phosphor material to one side of a film base, on the glass substrate so that said phosphor is come into contact with the barrier ribs formed in the step (e) rolling a phosphor filling roller, which has protruding portions corresponding to the positions of the discharge cells to be formed, on the phosphor material sheet laminated in the step (d) to fill said phosphor into the discharge cells between the adjacent barrier ribs;

(f) peeling the film base from the phosphor material sheet;

(g) removing the excess phosphor which is not supplied to the discharge cells in the step (e) and remained on the top faces of the barrier ribs; and (h) firing the phosphor filled in the discharge cells.

That is, the phosphor material sheet is laminated on the glass substrate having the barrier ribs thereon and the roller in which the recessed and embossed pattern (groove pattern) obtained by reversing the recessed and embossed surface of the barrier rib structure has been formed on the peripheral surface is rolled on the above laminated sheet, so that the discharge cells between the barrier ribs are filled with the phosphor. As for the phosphor filling roller used in this case, the roller similar to the barrier rib forming roller mentioned above can be used.

In the steps (d) to (g) of supplying the phosphor to the glass substrate on which the barrier ribs are formed, when a PDP capable of color displaying by using different color phosphors is manufactured, the steps of (d) to (g) are repeated for each of the different color phosphor material sheets. They are repeated for each of e.g. R (red), G (green), and B (blue) phosphor material sheets. In place of repeating the steps (d) to (g) for the different colors, repeating the steps (d) to (f) every color and removing all of excess phosphor material pastes in the next step (g) in a lump may also be performed.

The roller (phosphor filling roller) which is used in the step (e) for respective color phosphor material sheets has embossed or protruding portions on the positions of the discharge cells corresponding to respective colors. For the glass substrate having the barrier ribs in, for example, a vertical stripe form thereon, a roller-in which annular embossed lines (protruding portions) are formed at intervals of three pitches of the stripe-shaped discharge cells is used. For the different color phosphor material sheets, the same roller can be used by deviating in the axial direction (width direction) one pitch by one. It is a matter of course that the peripheral velocity of the phosphor filling roller is allowed to coincide with the relative linear moving speed of the glass substrate in a manner similar to the case of the above rib forming roller.

In order to remove the excess phosphor material paste in the step (g), the surface on which the barrier ribs are formed is directed downwardly and a knife edge is moved so as to apply the top face of each barrier rib, so that the excess phosphor adhered on the top face of the barrier rib can be scraped off. Before firing the phosphor material paste, it can be easily scraped off by applying the knife edge. The excess phosphor material paste can be also removed after firing. In this case, it is sufficient to perform scraping off by an abrading apparatus having a rotational abrasive disc made of grindstone and, after that, cleaning.

When the film base of the phosphor material sheet is separated or peeled off in the step (f), the excess phosphor material paste (i.e., phosphor material paste other than the phosphor material paste filled in the target discharge cells) is often adhered to the film base and partly removed from the barrier ribs. In this case, after all of color phosphor material pastes are filled, the excess phosphor material pastes still remaining on the barrier ribs may be removed in a lump.

Preferably, before rolling the phosphor filling roller, the hardness of the phosphor material paste is adjusted by leaving it in a solvent vapor of the phosphor material paste for predetermined period of time. Softening the phosphor material paste and support film enables the pressing force of the phosphor filling roller to be reduced. In this instance, the phosphor material paste has substantially the same composition as that of the glass paste for the barrier rib formation and contains a phosphor material powder in place of the glass powder. As for the film base which is used for the phosphor material sheet, a film having flexibility such that the film is easily extended by the embossed portions of the roller upon rolling the roller, being softened in the solvent vapor or gas and having transmitting properties for the vapor is desirably used.

The phosphor filling roller may be rolled in one direction only once and it can be also relatively moved reciprocatingly on the- same path. It is preferable that the diameter of the phosphor filling roller is set to 30 to 300 mm and the relative peripheral velocity is set to 0.05 to 2.0 m/min.

The second object of the present invention can be accomplished by a method of forming discharge cells for a plasma display panel having a plurality of discharge cells intervening between a pair of glass substrates formed with electrodes, the discharge cells being partitioned by the barrier-ribs, said method comprising the steps of:

(a) forming an uncured barrier rib material layer having flexibility on the surface of at least one of said glass substrates, on which said electrodes are formed;

(b) rolling a rib forming roller, which has the peripheral surface provided with grooves corresponding to the barrier ribs to be formed, on said barrier rib material layer while its peripheral velocity is allowed to coincide with the relative linear moving speed of the glass substrate so that the grooves embosses the barrier rib material layer to form freestanding structures corresponding to the barrier ribs on the glass substrate;

(c) drying and firing a barrier rib material shaped into the freestanding structures in the step (b) to form the carrier ribs partitioning the discharge cells;

(d) superposing a screen mask on the glass substrate and supplying a predetermined color phosphor material paste to the positions of the predetermined discharge cells by a screen printing method;

(e) drying the phosphor material paste supplied in the step (d);

(f) rolling the phosphor filling roller, which has grooves at the same pitches as those of the rib forming roller used in the step (c), on the phosphor material paste so that extruding portions between the grooves contacts and fills the phosphor material paste into the discharge cells;

(g) removing the excess phosphor material paste remained on the top face of each barrier rib; and (h) firing the phosphor material paste filled in the discharge cells.

The barrier rib forming roller used in the step (b) can be used as a phosphor filling roller used in this case. That is, since the freestanding structures (i.e., uncured barrier ribs, which is also referred to as "pre-ribs") formed by the barrier rib forming roller are shrunk by drying and firing to form the finished barrier ribs in the step (c), gaps are formed between the ribs after firing and the rib forming roller. Therefore, it is possible to fill the phosphor material paste into the discharge cells by using the gaps.

In the case of the PDP for color display, the step (d) is repeated for each of the different color phosphor material pastes. After the color phosphor material pastes are supplied to the corresponding discharge cells, the phosphor material pastes can be filled into all of the discharge cells in a lump in the step (f). When the supply amount of the phosphor material paste to be supplied to the discharge cells by the screen printing in step (d) is set larger than a finally required amount to the discharge cells, a sufficient amount of phosphor material paste can. be filled into each discharge cell but excess phosphor material paste overflows from the discharge cells to the outside. Therefore, the overflowing phosphor material paste may be scraped off by using a knife edge, doctor blade or the like. The excess phosphor material paste can be easily removed before firing the phosphor material paste.

Further, the second object of the present invention is accomplished by a method of forming discharge cells for a plasma display panel having a plurality of discharge cells intervening between a pair of glass substrates on which electrodes are formed, the discharge cells being partitioned by barrier ribs, a phosphor material layer being formed in the internal surface of each discharge cell, comprising the steps of:

(a) forming an uncured barrier rib material layer having flexibility on the surface of at least one of said glass substrates, on which said electrodes are formed;

(b) forming on the barrier rib material layer a phosphor material layer in which phosphor materials are arranged at pitches equivalent to those of the discharge cells to be formed;

(c) rolling a roller, which has an intaglio recessed pattern corresponding to a desired pattern for the barrier ribs to be formed, on said phosphor material layer. and barrier rib material layer so that the recessed pattern forms freestanding structures corresponding to the barrier ribs on the glass substrate and fills the phosphor material in spaces between the adjacent freestanding structures; and (d) drying and firing a barrier rib material shaped into the freestanding structures and the phosphor material between the freestanding structures, whereby the discharge cells partitioned by the barrier ribs and having the phosphor material layer on the internal surface are formed.

In this aspect of the invention, a lamination of the barrier rib material and phosphor material on the glass plate is simultaneously pressed or rolled by the single roller in which a recessed and embossed pattern (groove pattern) obtained by reversing the recessed and embossed surface of the barrier rib structure is formed on the peripheral surface. A roller similar to the above-mentioned barrier rib forming roller can be used as a rolling roller used in this case.

Preferably, a release agent is applied to or coated on the surface of the barrier rib material layer in order to improve the release properties to the roller. As for the release agent, the talc powder or powder of the Teflon-based additive, paste containing the powder, and spray liquid made by dispersing the powder in oil are suitable. The release agent may be applied thin by the spray or roll coater. It is preferable that the barrier rib material layer be softened by leaving it in its solvent vapor or gas for a predetermined period of time, adjusted to have an optimum. hardness, and then pressurized by the roller. The release agent may also be applied after softening in the solvent vapor.

As for the solvent used in the softening process, a solvent that is compatible with a resin binder contained in the glass paste as a barrier rib material may be used. For example, an aromatic solvent such as toluene or higher alcohol may be used. In case of applying the release agent, it is desirable to perform the softening process of the glass paste by the solvent vapor before coating of the release agent in order to uniformly soften the paste. When the release agent has a nature for allowing a-solvent to pass therethrough, the softening process may be performed after applying the release agent.

It is necessary to move the peripheral surface of the roller and the glass substrate at the same speed without sliding at a contact portion therebetween. For this purpose, both of them are made to relatively linearly move while the peripheral velocity of the roller is allowed to coincide with the relative linear moving speed of the glass substrate to the roller. Although the roller may be relatively moved in one direction only once, it may also be reciprocatingly moved on the same path (passage) plural times. Passing the same path of plural times in this manner enables the grooves to be gradually formed deeply on the rib material layer, so that it is possible to prevent the rib material or phosphor material from adhering to the roller and peeling from the glass substrate.

After the roller is rolled on the phosphor material layer and barrier rib material layer to form the embossed lines corresponding to the barrier ribs [step (c)], a process to form a black mask on the-phosphor material layer at the position of each barrier rib can be added. In this case,-the process for the black mask which is formed on the front glass substrate in the conventional PDP is unneeded or simplified. the black mask can be easily formed by a method such as screen printing.

The phosphor material layer which is formed in the step (b) can be formed on the top surface of the barrier rib material layer by printing. When a black anti-reflection material is contained in the phosphor material layer on positions corresponding to the barrier ribs, the black mask constituted by the black anti-reflection material can be formed together with the barrier ribs and phosphor material layer in the same firing process, so that the productivity is further improved.

When the phosphor material layer is formed by laminating a previously prepared green sheet instead of the printing, the processing efficiency is raised to obtain good working properties. As for the green sheet made of phosphor material which is used in this case, a sheet made by arranging different color phosphor materials so as to correspond to the respective discharge cells is used. The black anti-reflection material can be also contained in the sheet on positions corresponding to the barrier ribs.

The third object of the present invention is accomplished by a sheet made of phosphor materials, which is made by sandwiching different color phosphor materials between a pair of upper and lower detachable film bases so as to correspond to the respective discharge cells. The sheet can be manufactured by the following method.

That is, the fourth object of the present invention can be accomplished by a method of manufacturing a phosphor material sheet which is used to form discharge cells by supplying phosphor to portions between barrier ribs formed on a glass substrate of a plasma display panel, comprising the steps of:

(a) forming a release layer on a lower film base;

(b) printing a first color phosphor to the whole upper surface of said release layer at a uniform thickness;

(c) rolling a first roller on the printed first color phosphor, said first roller having grooves formed on the positions of the discharge cells corresponding to the first color so that said first color phosphor is gathered into the grooves and form first color embossed portions, and drying the formed portions;

(d) printing a second color phosphor to the upper surface of said release layer except said first color embossed portions;

(e) rolling a second roller on the printed second color phosphor, said second roller having grooves formed on the positions of the discharge cells corresponding to the first and second colors so that said second color phosphor is gathered into the grooves of the second roller to form second color embossed portions neighboring the first color embossed portions, and drying the formed portions;

(f) printing a third color phosphor to the upper surface of the release layer except said first and second embossed portions; and (g) laminating an upper film base through the release layer.

DETAILED DESCRIPTION OF THE PREFERRED EMBODIMENTS

First Embodiment

An embodiment of the barrier rib forming method of the invention is described hereinafter with references to FIGS. 4 to 8. First, a structure of the PDP will now be explained with reference to FIG. 1.

Structure of Plasma Display Panel

Figure 1:
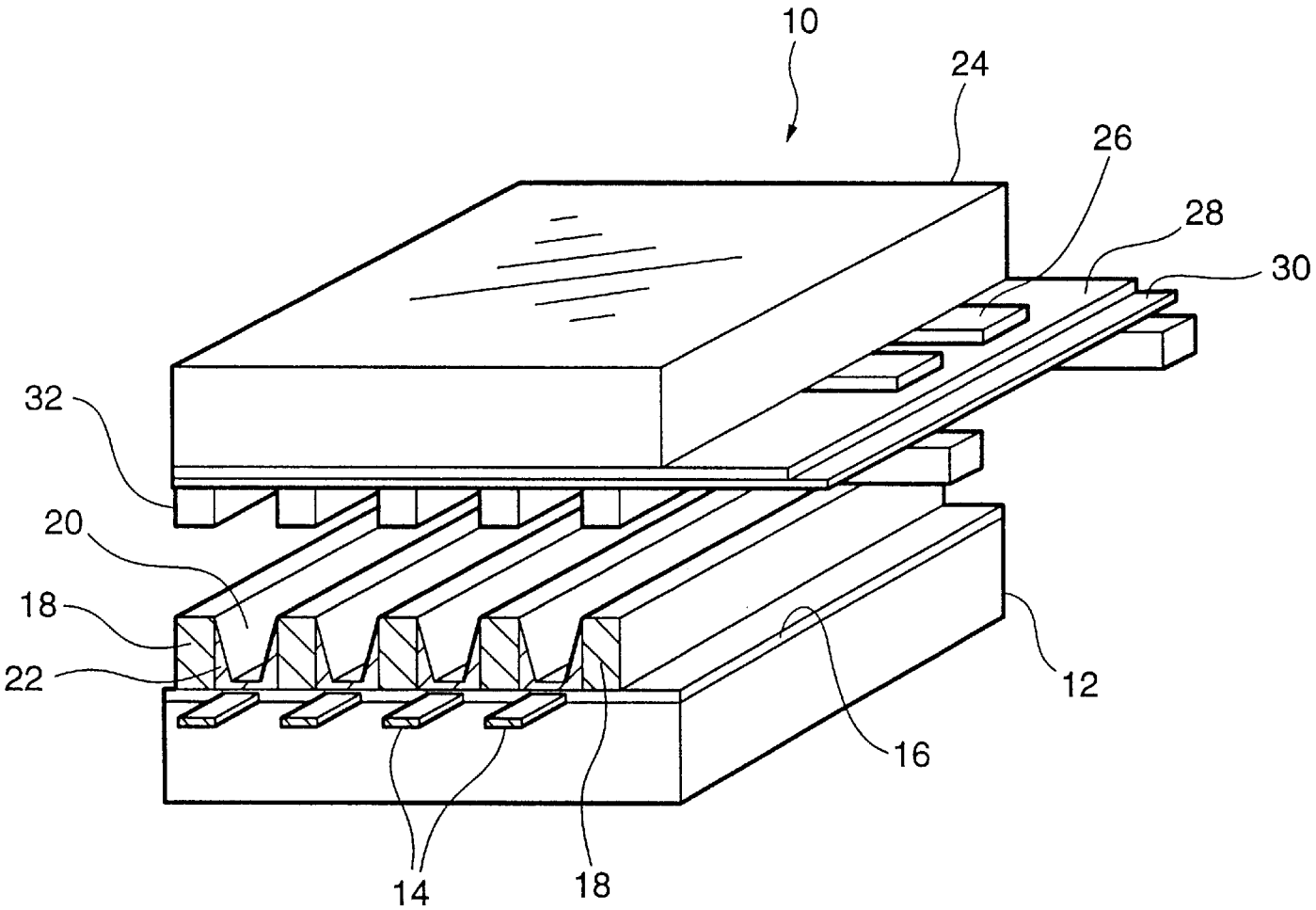
FIG. 1 is an exploded perspective view of the schematic structure of a plasma display panel of AC-driven surface discharge PDP.

A PDP 10 shown in FIG. 1 is an alternating current surface discharge type one. For the PDP 10, stripe shaped data electrodes (address electrodes) 14 are formed on a rear glass substrate 12 and covered with an insulating layer composed of a rear dielectric layer 16. On the rear dielectric layer 16, barrier ribs (partition walls) 18 having a height of about 0.1 mm (100 $\mu$m) are formed by a method which will be described hereinafter. The electrodes 14 are formed in the vertical direction of the PDP and each of the barrier ribs 18 is arranged in parallel with each electrode 14 so as to be disposed between the two neighboring electrodes 14.

A phosphor 22 is applied to the inside of each groove 20 surrounded by the side surfaces of the barrier ribs 18 and the data electrode 14. In case of the PDP 10 for color display, red, green, and blue phosphors 22 to be applied to the neighboring grooves 20 are arranged in accordance with this order. Each groove 20 extending in the vertical direction constitutes a discharge space, namely, a discharge cell.

Transparent electrodes 26 are formed in a stripe form in the horizontal direction on a front glass substrate 24. The whole surface of the front glass substrate 24 including the transparent electrodes 26 is covered with a transparent dielectric layer 28 and an MgO protective film 30 is deposited onto the covered surface. In the PDP 10, a black mask 32 composed of black dielectric material is formed in a lattice form on the MgO protective film 30, so that image contrast is raised to improve a picture quality. That is, portions except openings of the discharge cells corresponding to pixels are covered with the black mask Formation of Barrier Rib A method of forming the barrier ribs 18 on the rear glass substrate 12 will now be described with reference to FIGS. 2 to 8. According to the invention, as shown in FIG. 3, a rib material layer 50 is formed on the glass substrate 12 on which the electrodes 14 has previously been formed and which has been covered with the dielectric layer 16. The substrate is held an a carrying table 52 and conveyed. A roller (rib forming roller) 54 disposed in the direction perpendicular to the moving direction of the carrying table 52 is rolled on the rib material layer 50, thereby transferring an annular groove or recessed pattern formed on the roller 54 to the rib material layer 50. Drying and firing the pattern forms the barrier ribs 18.

Referring to FIG. 3, a motor 56 allows the roller 54 to rotate. The peripheral velocity of the roller 54 is made to coincide with a carrying speed V of the substrate 12. That is, when it,is assumed that the radius of the roller 54 (for example, a mean value of the radius of the outermost periphery and the radius of the periphery corresponding to the bottoms of the grooves) is set to R and a rotational angle speed is set to ω (radian/sec), the roller is rotated so as to satisfy the following equation.

$$R\omega = V$$

Figure 2:
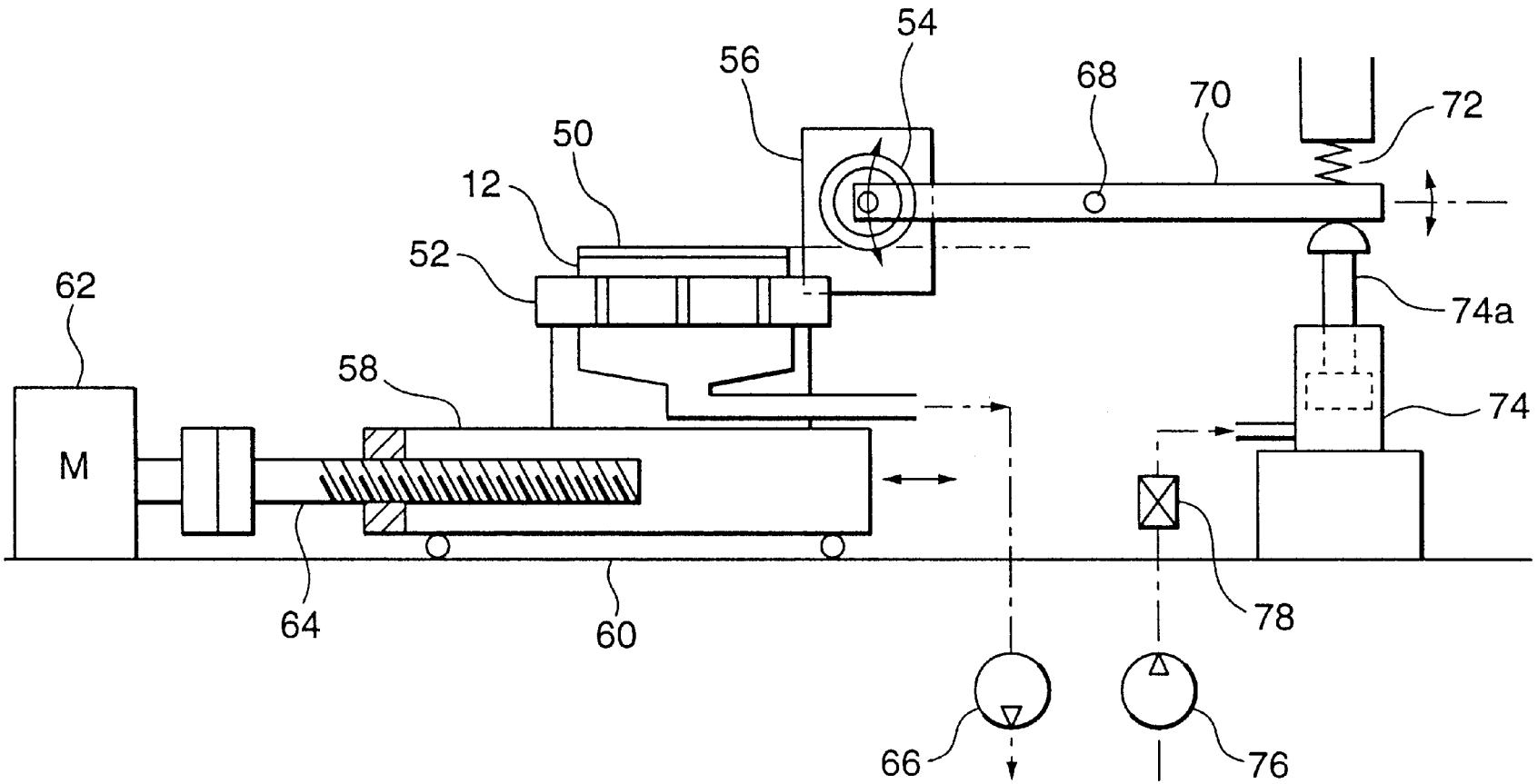
FIG. 2 is a diagram showing an embodiment of an apparatus which is used for embodying a method of forming barrier ribs and a method of forming discharge cells for the PDP according to the present invention.
Figure 3:
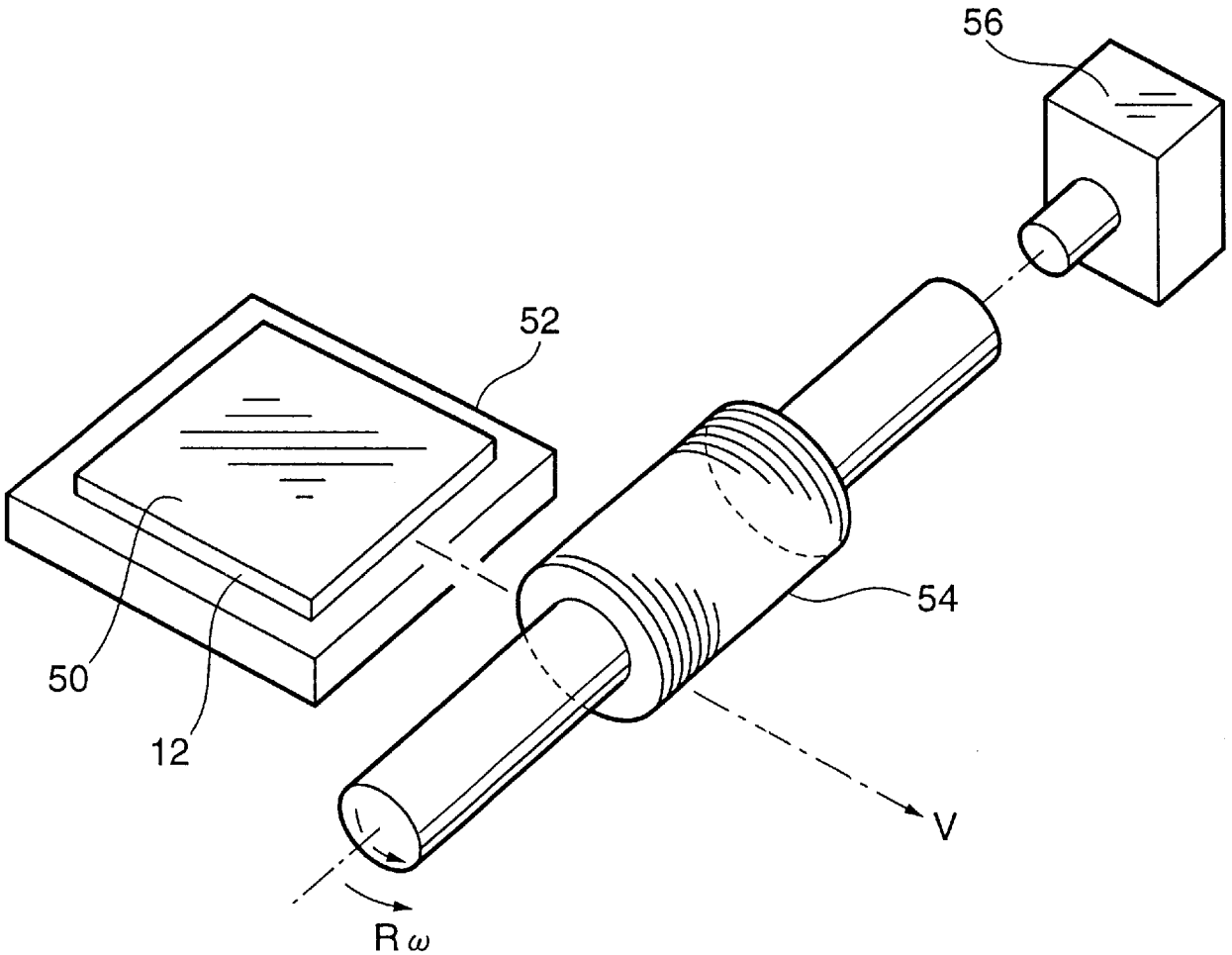
FIG. 3 is a principle explanatory diagram of the method of forming the barrier ribs for the PDP according to the present invention.

An apparatus for embodying the method can be constructed as shown in FIG. 2. Referring to FIG. 2, reference numeral 58 denotes a carriage for moving the carrying table 52. The carriage 58 is movable on rails 60 in the horizontal direction. The carrying table 52 is horizontally fixed to the upper surface of the carriage 58. The carriage 58 is linearly moved by a feed screw 64 which is rotated forwardly and reversely by a motor 62. A suction negative pressure is introduced to the surface of the carrying table 52 by a suction air pump 66. The glass substrate 12 is held on the upper surface of the carrying table 52 by the suction negative pressure.

The roller 54 and motor 56 are held on one end of a support arm 70 which is held by a shaft 68 so as to be rockingly movable. The other end of the support arm 70 is pressed downwardly by a balance spring 72 from the upper side and is pressed upwardly by a piston rod 74*a* of an air cylinder 74 from the lower side. Pressure air from a pressure air pump 76 is introduced to the air cylinder 74 through a control valve 78. The pressing force of the piston rod 74*a* against the support arm 70 can be controlled by the control valve 78. Accordingly, the pressing force of the roller 54 against the rib material layer 50 can be controlled by the control valve 78.

It is desirable that the dimension of a gap or interval between the roller 54 and the glass substrate 12 can be set with high precision. For example, an auxiliary roller (not shown) which is rolled so as to come into contact with the surface of the carrying table 52 or the surface near the periphery of the glass substrate 12 (for example, an area to form a sealing material for hermetically sealing a spacing between the front and rear glass substrates can be used), is provided for the support arm 70. The gap dimension between the roller 54 and the glass substrate 12 can be adjusted depending on the height of the auxiliary roller. Aternatively, annular embossed or protruding portions which are come into contact with the surface near the periphery on both the sides of the glass substrate 12 are provided for both ends of the roller 54. The gap dimension can be adjusted by properly setting the height of each embossed portion.

Figure 4:
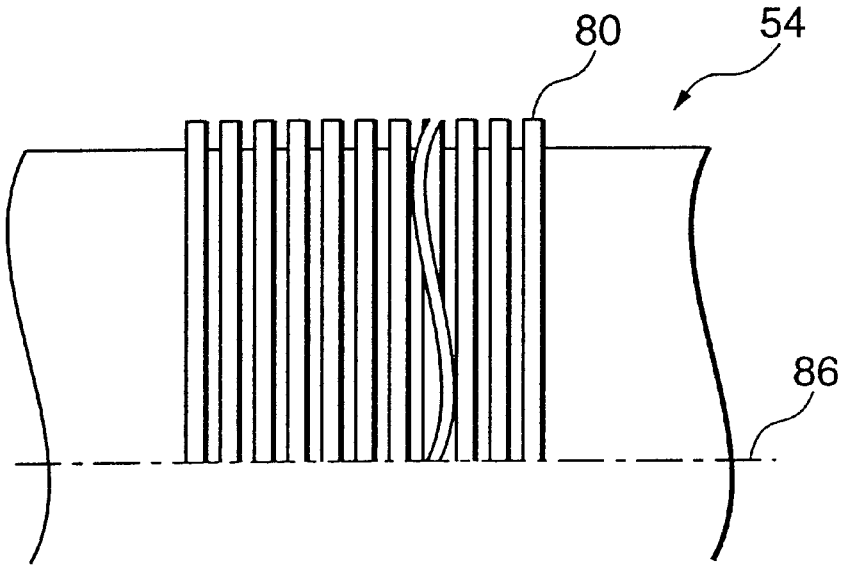
FIG. 4 is a partially enlarged view of a rolling roller which is used in the barrier ribs forming method and discharge cells forming method of the present invention.
Figure 6:
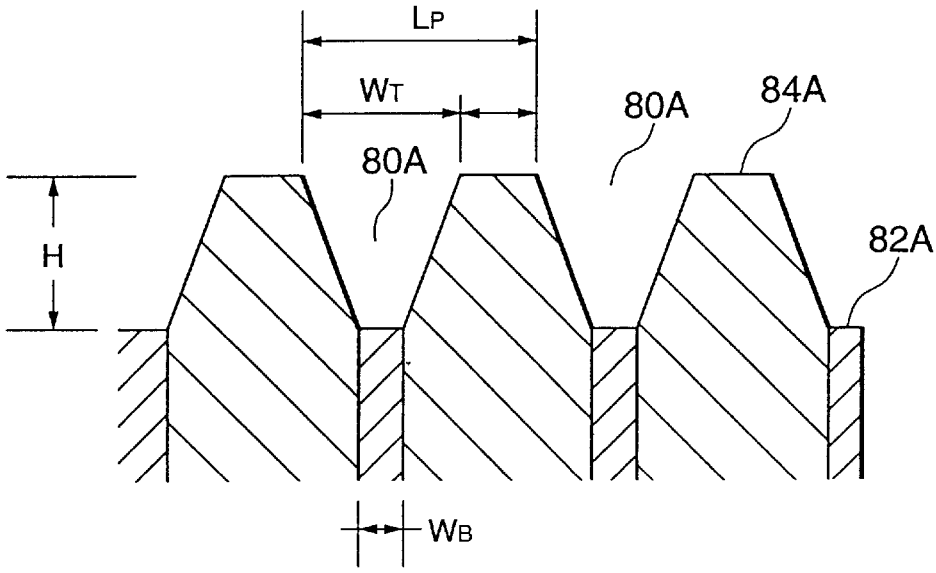
FIG. 6 is a view obtained by sectioning another form in section of the annular grooves on the roller along the roller center axis.
Figure 7:
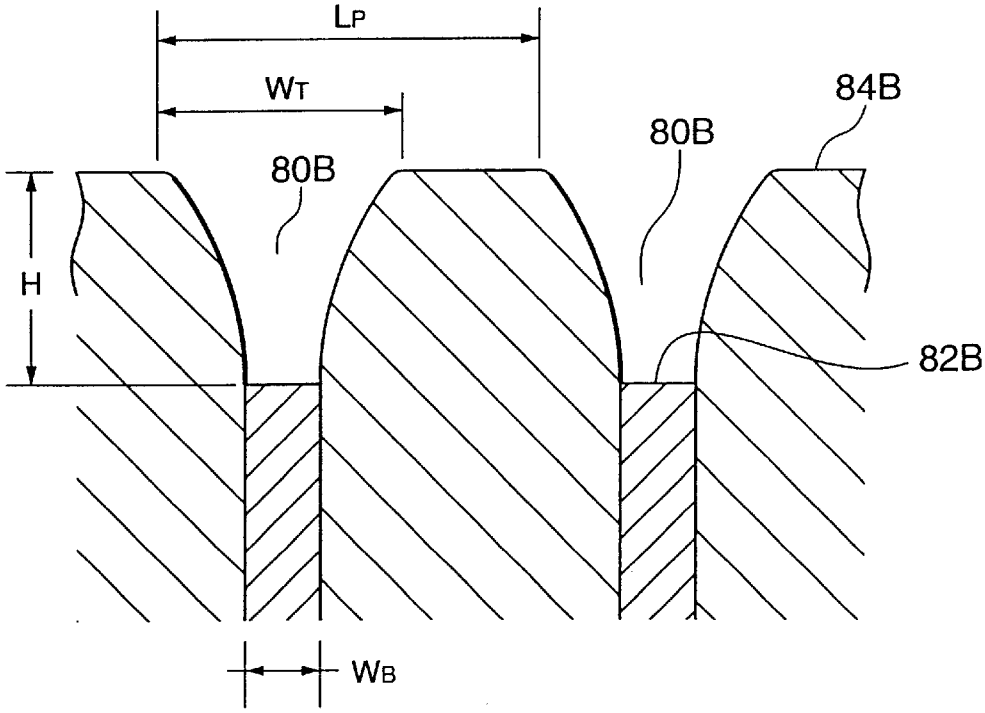
FIG. 7 is a view obtained by sectioning another form in section of the annular grooves on the roller along the roller center axis.

It is a matter of course that the groove pattern of the roller 54 used in this instance is made to correspond to the shape of the rib 18 to be formed. In case of forming the stripe-shaped ribs 18 shown in FIG. 1, as shown in FIG. 4, the roller on which annular grooves 80 are formed at the same intervals (pitches) as those of the ribs 18 is used. The roller 54 can be formed in such a manner that, as shown in FIGS. 5 to 7, two kinds of discs 82 and 84 having different diameters are alternately stacked with fitting each center axis to a center axis 86 of the roller.

Figure 5:
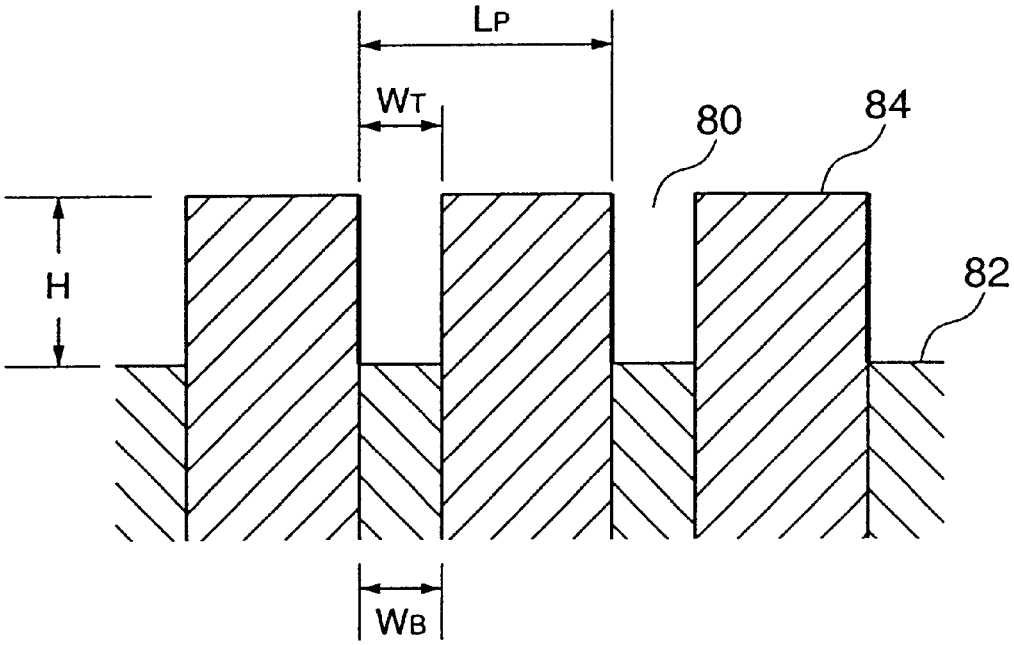
FIG. 5 is a view obtained by sectioning a form in section of annular grooves on the rolling roller along the center axis of the roller.

Referring to FIG. 5, in case of forming rectangular grooves 80, a difference between the. radius of the small disc 82 and the radius of the large disc 84 becomes the depth, that is, the height H of the groove. The thickness of the disc 82 indicates the opening width $W_T$ and the bottom width $W_B$ of the groove 80. The total thickness of both the discs 82 and 84 denotes the pitch $L_P$ of the groove 80.

Since the form of the groove 80 in section corresponds to the form of the rib 18 in section, the form of the rib 18 in section can be changed by changing the form of the groove in section. According to the groove 80 having a rectangular section in FIG. 5, the rib having a substantially rectangular section can be formed. FIG. 6 shows grooves 80A having an inverse trapezoidal form and FIG. 7 shows groove 80B having an inverse trapezoidal form with curved sides. The grooves 80A can be formed in such a manner that a linear chamfering process is performed to peripheries of both sides of a disc 84A having a large diameter. to slope the peripheries and the result ant discs 84A and discs 82A having a small diameter are alternately laminated. The grooves BOB of FIG. 7 can be formed as follows. In a manner similar to the above, the peripheries of both sides of a disc 84B having a large diameter is chamfered so as to have a curve in a circular arc-like form in section and the resultant discs 84B and discs 82B having a small diameter are alternately stacked.

Figure 8:
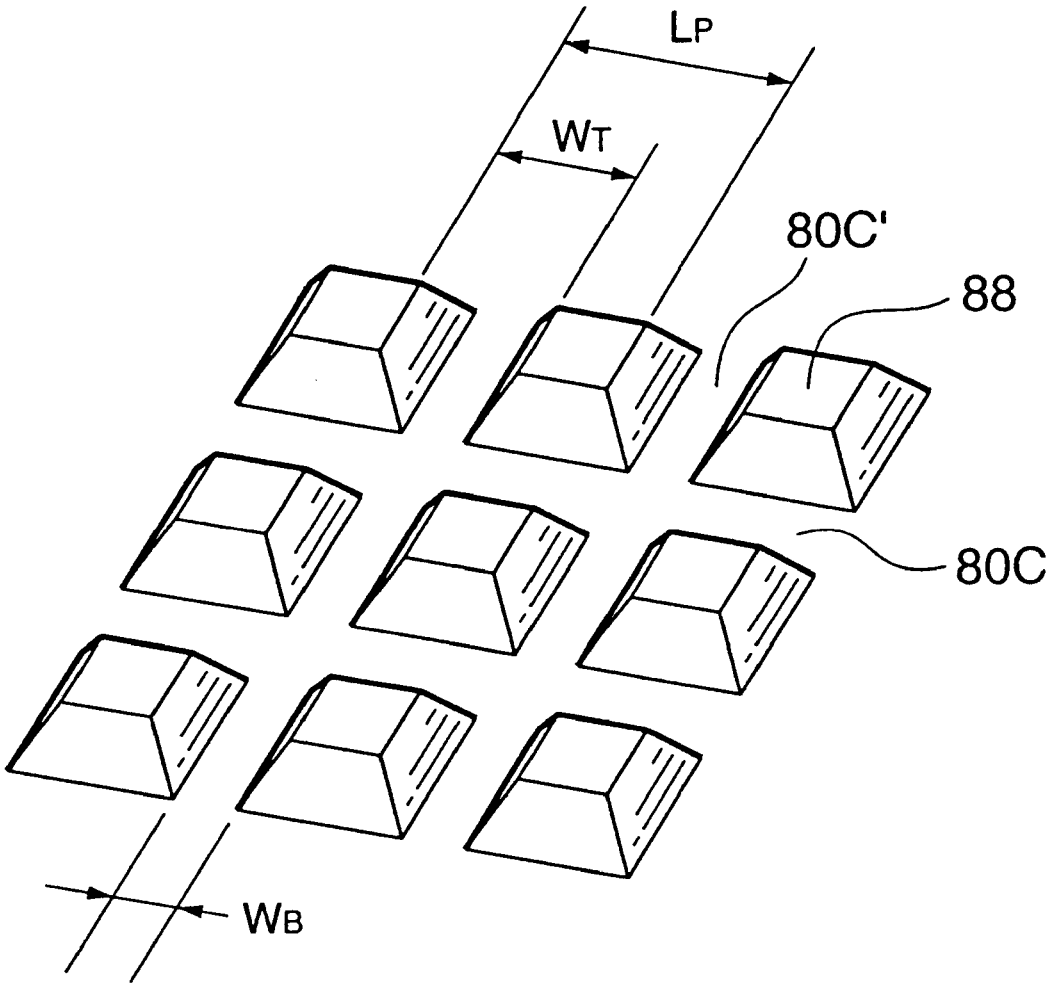
FIG. 8 is a perspective view showing a lattice-shaped grooves pattern of the roller which is used for forming a closed-cell barrier structure.

In case of forming the ribs 18 in a lattice or criss-crossing form, the roller 54 having a groove pattern shown in FIG. 8.is used. Specifically, on the peripheral surface of the roller 54, top-cut pyramid-like embossed portions 88 having the pitch $L_P$, opening width $W_T$, and bottom width $W_B$ corresponding to the discharge cells are formed, thereby grooves 80C and 80C' perpendicular to each other are formed between the embossed. portions 88. Such roller 54 is used for forming closed-cell barrier structure.

Figure 9:
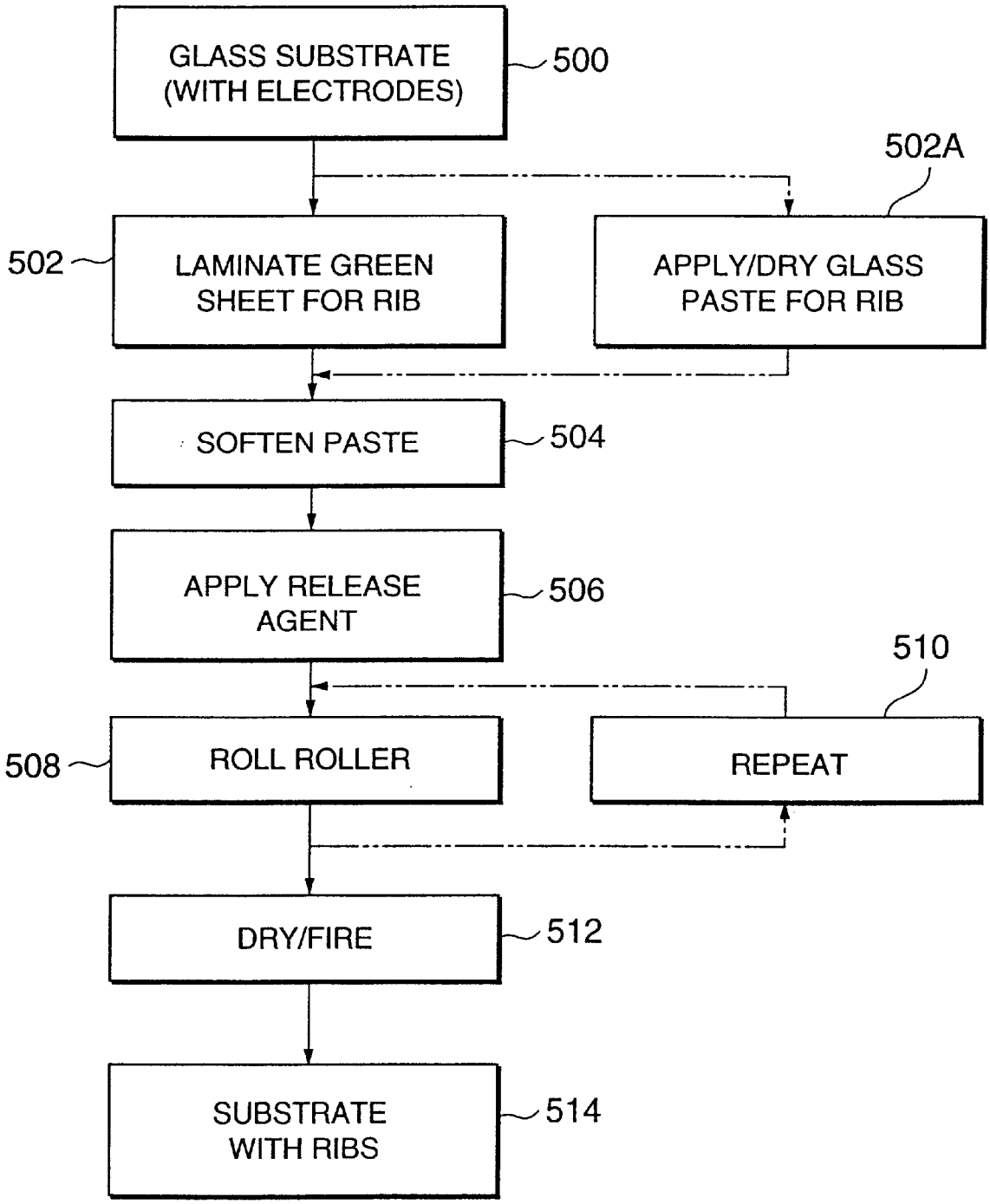
FIG. 9 is a flowchart of a barrier rib forming process according to a first embodiment of the present invention.
Figure 10A:
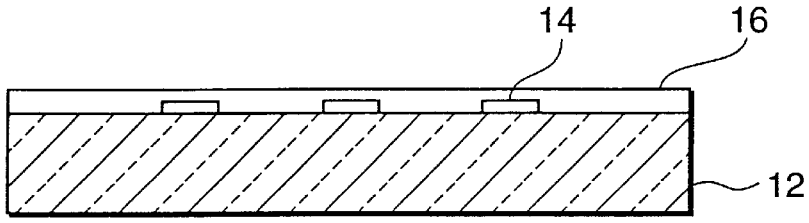
FIGS. 10A to 10D are cross-sectional views showing processes of the barrier rib forming method according to the first embodiment of the present invention.
Figure 10B:
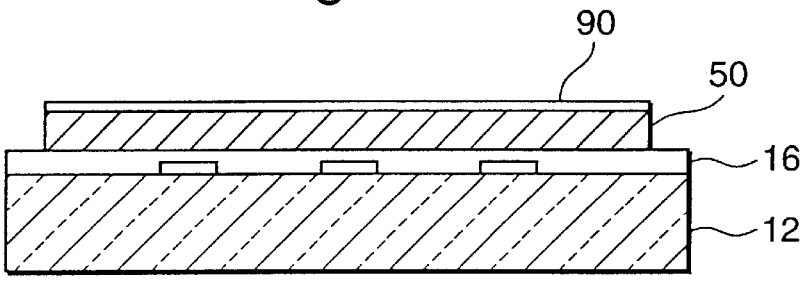

A rib forming process will now be described with reference to FIGS. 9 and 10A to 10D. FIG. 9 is a flowchart of the process. FIGS. 10A to 10D are schematic sectional views of processing steps. First as described above, there is prepared the rear glass substrate 12 on which the electrodes 14 and rear dielectric layer 16 are formed (step 500 in FIG. 9). FIG. 10A shows the glass substrate 12 in this state. As shown in FIG. 10B, the rib material layer 50 (refer to FIGS. 2 and 3) is formed on the surface of the glass substrate 12 (steps 502 and 502A).

As a method of forming the rib material layer 50, a method of laminating a green sheet for rib on the surface of the glass substrate 12 is convenient to make a uniform thickness because the working properties are good (step 502). The green sheet is formed by sandwiching a glass paste for rib in a sheet form having a uniform thickness between protective sheets. The green sheet is used in such a manner that one of the protective sheets is peeled off, the green sheet is adhered to the glass substrate 12, and the other protective sheet is peeled off just before rolling the roller, which will be described hereinafter. A liquid glass paste for rib is applied to the glass substrate 12 so as to have a uniform thickness and dried and the resultant one can be used in place of the green sheet (step 502A).

The glass paste for rib is-made of a composition containing a glass powder and a resin binder as main components and has desired characteristics by adding proper additive and solvent to the above main composition. The glass powder contains sulfur (S), selenium (Se), and alum in addition to silicate and, particularly, it is allowed to contain lead oxide or the like in order to reduce a melting point. Various sintering aids are also added. The grain diameter of the powder is set to about tens of microns (em) to submicrons. Examples of the resin binder to be used include vinyl ether, methacrylate, urea resin, phenolic resin, epoxy resin, unsaturated polyester resin, and their precursors. The amount of the resin binder is set to 10 to 20 parts by weight for the glass powder of 100 parts by weight.

As for the additive, a hardening accelerator, a plasticizer, a dispersant, a wetting improver, a leveling agent, an anti-foaming agent, an anti-oxidant, a ultraviolet absorber, or the like can be used. The solvent which is compatible with the resin binder can be used. An aromatic solvent such as toluene, xylene, and phthalic ester, higher alcohol such as hexanol, octanol, and oxy alcohol, or esters such as acetate may be used.

Figure 10C:
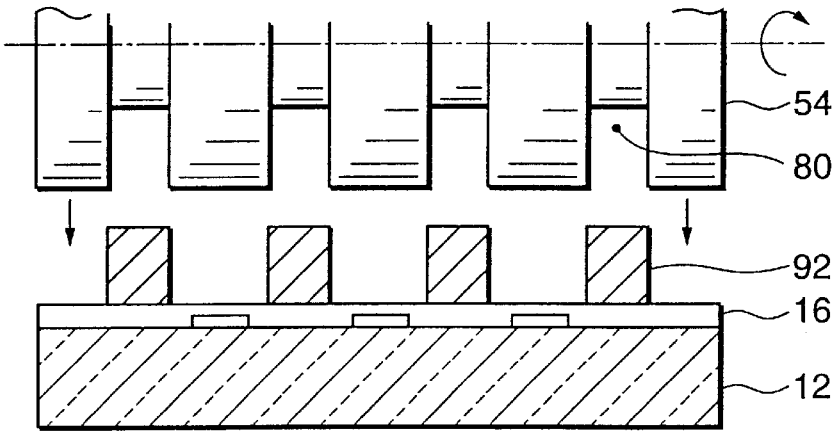

The glass substrate 12 on which the rib material layer 50 has been formed in this manner is left in the solvent vapor for a predetermined period of time to soften the rib material layer 50, so that working properties by the roll 54 are improved (step 504). A release agent 90 (refer to FIG. 10B) is applied to the surface of the rib material layer 50 by spraying (step 506) and, after that, the roller 54 is rolled (step 508). Since the groove pattern is formed on the roller 54, the rib material flows and gathers into the grooves 80 (80A to 80C, refer to FIGS. 4 to 8) of the groove pattern. Embossed lines or pre-ribs 92 whose form in section coincides with the form of the groove 80 of the roller 54 are. formed as freestanding structures (FIG. 10C).

Although the roller 54 may be rolled only once, it can be reciprocatingly moved on the same path (passage) once or plural times (step 510). Since the release agent 90 has been applied to the rib material layer 50, the rib material is not adhered to the roller 54. The release agent 90 may also be applied to the surface of the roller 54. It may also be applied to both of the surfaces of the roller 54 and the rib material layer 50. The thickness of the rib material layer 50 should be determined in consideration of the sectional area of the groove 80 of the roller 54. In consideration of an amount of shrinkage of the rib material after firing, the sectional area of the groove 80 should be determined so that the form of the embossed pre-rib 92 after firing becomes the rib 18 having desired height and width.

Figure 10D:
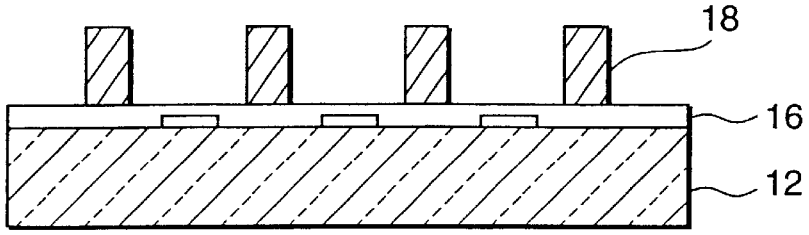

After the embossed pre-ribs 92 made of the rib material are formed by rolling the roller 54, the glass substrate 12 is sequentially carried into a drying furnace and a firing (or baking) furnace (step 512). Drying and firing may also be performed in such a manner that the same furnace is used as a drying furnace-and a firing furnace and a temperature in the furnace is sequentially raised in accordance with a preset program. In this instance, the rib material forming the embossed pre-rib 92 is dried and further fired, so that the glass substrate with the barrier ribs 18 is obtained (FIG. 10D, step 514).

When a black anti-reflection material is applied to the upper surface of each embossed pre-rib 92 by the screen printing before drying and firing, a black anti-reflection layer serving as a black mask can be simultaneously dried and fired together with the ribs 18.

According to the first embodiment of the invention, the uncured barrier rib material layer having flexibility is formed on the glass substrate, and the roller on which the groove pattern corresponding to a desired pattern of the barrier ribs has been formed is rolled on the barrier rib material layer. Accordingly, the embossed pre-ribs made of the barrier rib material corresponding to the barrier ribs are formed. The pre-ribs are dried and fired to form the barrier ribs. According to the method, therefore, since the barrier ribs can be formed with high precision, the method is suitable for realizing the high definition and large size of the PDP.

The number of processing steps is reduced, so that the small size and small scale of a manufacturing apparatus can be realized. Further, since all of the material for the barrier rib material layer formed on the glass substrate is gathered to form the freestanding structures of the pre-ribs and is used as barrier ribs, the loss of the material for the barrier rib material is not generated and the number of processing steps is small, so that a yield upon manufacturing is raised and a manufacturing cost can be reduced.

Second Embodiment

Figure 11:
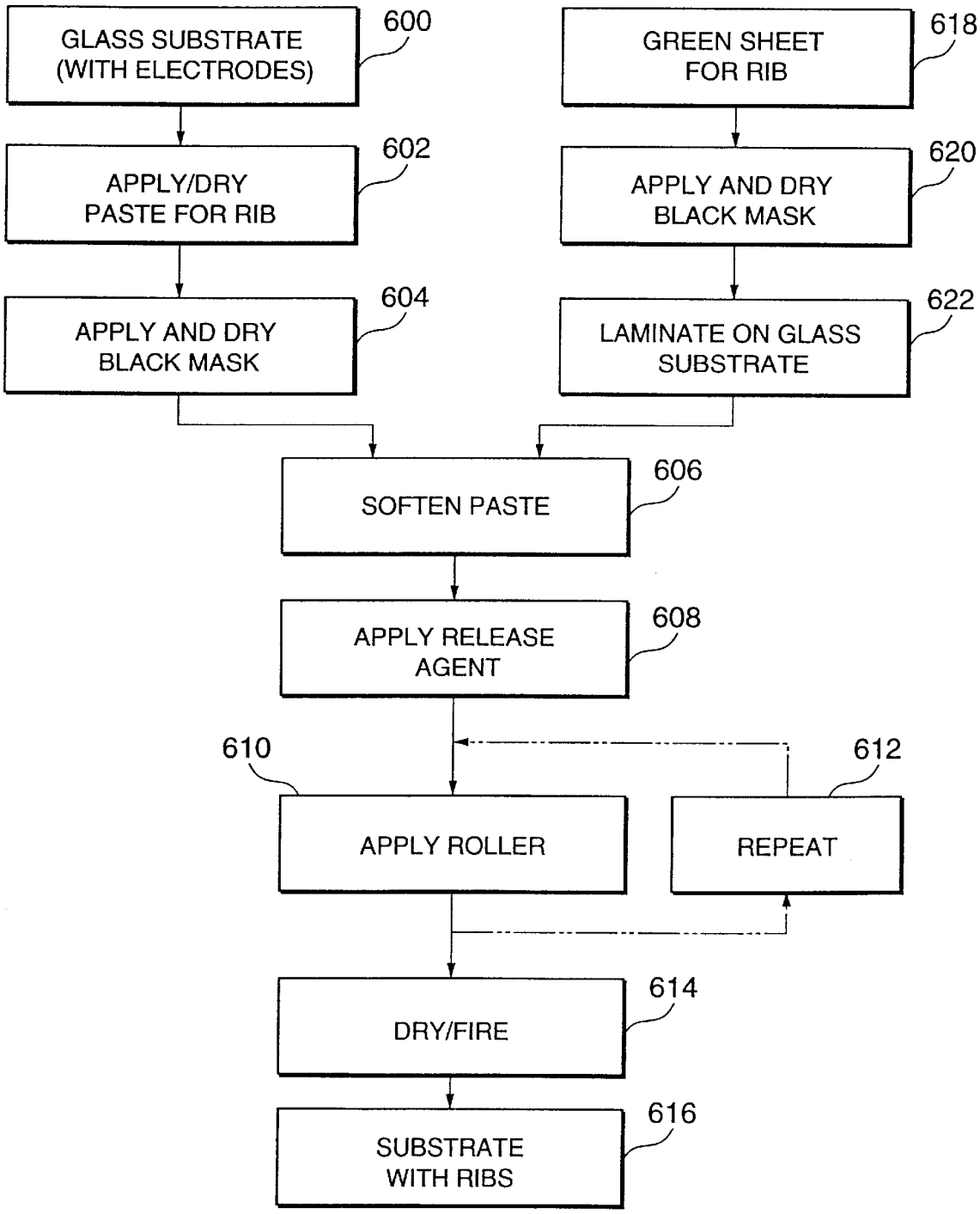
FIG. 11 is a flowchart of a barrier rib forming process according to a second embodiment of the present invention.

FIG. 11 is a flowchart of a rib forming process as a second embodiment of the present invention. FIGS. 12A to 12D are explanatory views of processing steps. The present embodiment relates to the formation of a black anti-reflection layer, i.e., a black mask on each barrier rib simultaneously with the barrier rib formation.

Figure 12A:
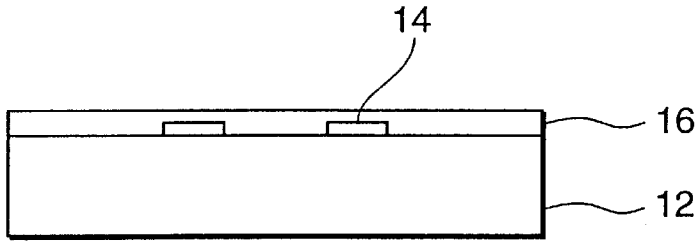
FIGS. 12A to 12D are cross-sectional views showing processes of the barrier rib forming method according to the second embodiment of the present invention.
Figure 12B:
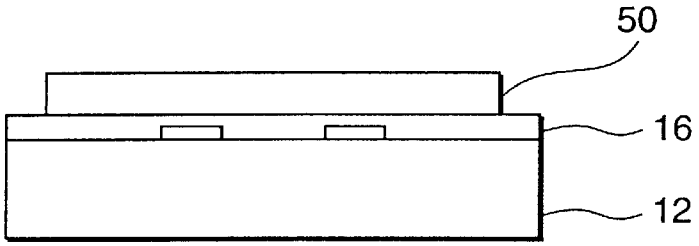
Figure 12C:
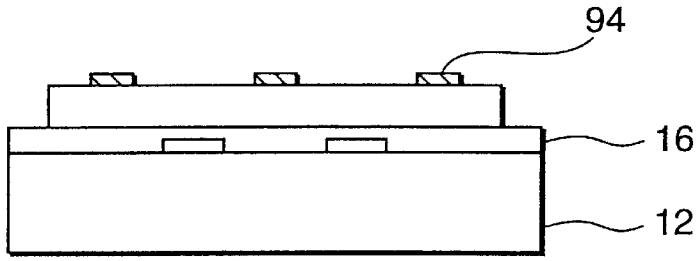

First, the rear glass substrate 12 on which the electrodes 14 and the rear dielectric layer 16 are formed is prepared (FIG. 12A, step 600 in FIG. 11). A glass paste for rib is applied to the glass substrate 12 and is dried to form the rib material layer 50 (FIG. 12B, step 602). A green sheet made of the glass paste can be laminated on the surface of the glass substrate 12 in place of applying and drying the glass paste. A black anti-reflection layer 94 is formed so as to correspond to the position of each barrier rib on the rib material layer 50 formed in this manner (FIG. 12C, step 604). For example, a black dielectric liquid is applied by printing and then dried.

Figure 12D:
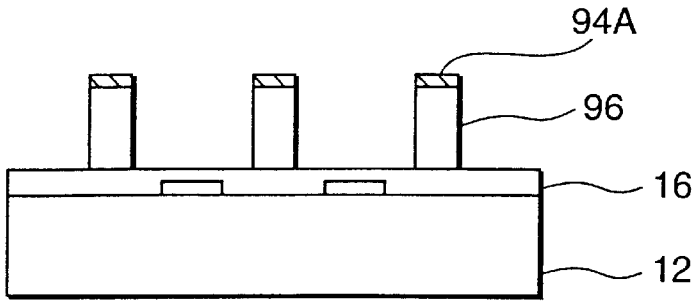

In a manner similar to the process of FIG. 9, a paste softening process (step 606) and applying of a release agent (step 608) are performed and the roller 54 is rolled (step 610). Consequently, embossed banks or pre-ribs lines 96 shown in FIG. 12D are formed. On the upper surface of each embossed banks 96, a layer 94A obtained by transferring the black anti-reflection layer 94 is formed. The roller 54 is reciprocatingly moved as necessary (step 612) and the formed layer is dried and fired (step 614), so that the glass substrate 12 with barrier ribs can be obtained (step 616). Each barrier rib has the black mask thereon.

According to the second embodiment, since the black anti-reflection layer is formed on the upper surface of each pre-rib simultaneously with the barrier rib forming process, the process for the black mask which is formed on the front glass substrate is unneeded or simplified, so that the productivity of the PDP is further improved.

Third Embodiment

FIGS. 13A to 13D are cross-sectional views for explaining a rib forming process according to a third embodiment of the present invention. In the second embodiment shown in FIGS. 12A to 12D, the black anti-reflection layer 94 is formed only on positions corresponding to the ribs to which the layer is directly printed on the surface of the rib material layer 50. In contrast, according to the third embodiment shown in FIGS. 13A to 13D, a sheet 100A obtained by printing a black anti-reflection layer (black mask pattern) 102 to a green sheet 100 different from the rib material layer 50 is laminated on the whole surface of the rib material layer 50.

Figure 13A:
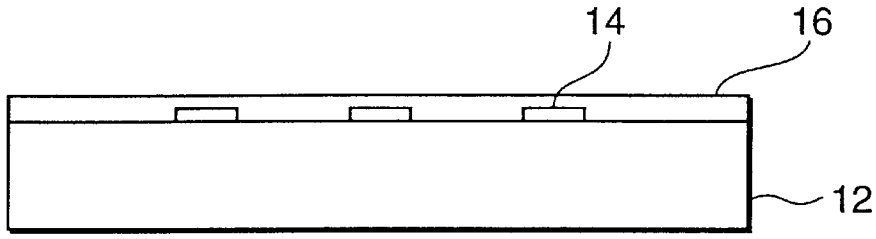
FIGS. 13A to 13D are cross-sectional views showing processes of a barrier rib forming method according to a third embodiment of the present invention.
Figure 13B:
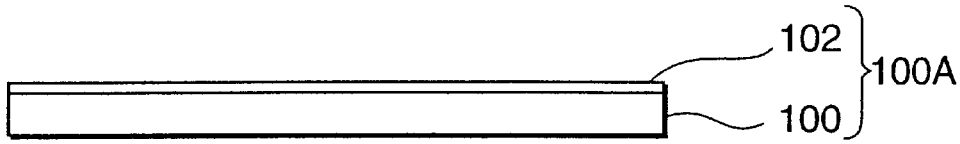
Figure 13C:
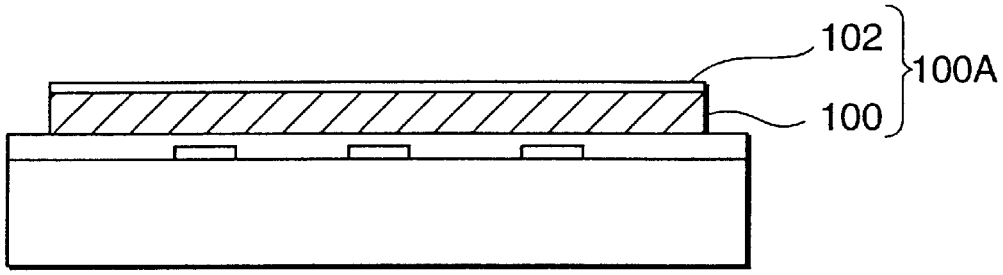
Figure 13D:
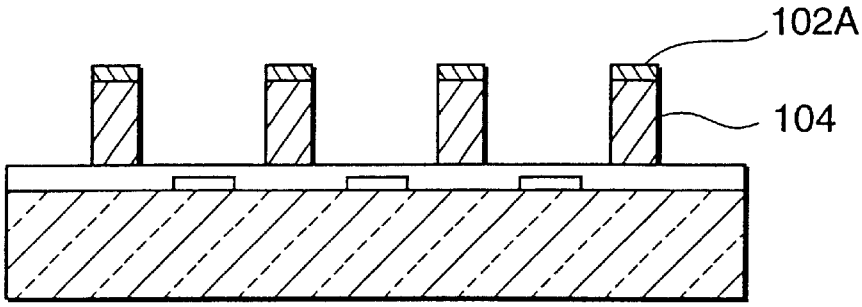

That is, the green sheet 100 made of the glass paste for rib (FIG. 13B) is prepared (step 618 in FIG. 11). The black anti-reflection layer 102 is printed-to a position corresponding to the top surface of each rib on the sheet (step 620). The green sheet 100A with the black anti-reflection layer 102 is laminated to the glass substrate 12 with the electrodes 14 shown in FIG. 13A (step 622, FIG. 13C). After the paste softening process (step 606) and applying of the release agent (step 608), the roller 54 is rolled to form embossed lines 104 made of the rib material as shown in FIG. 13D. The rib material and black anti-reflection layer 102 sandwiched between the embossed lines (pre-ribs) on the surface of the roller 54 and the surface of the glass substrate 12 (rear dielectric layer 14) are gathered into the grooves 80 (refer to FIGS. 4 to 8) of the roller 54 by rolling the roller 54. Consequently, the black anti-reflection layer 102 is gathered to the top surface of the embossed line (pre-ribs) 104 to form a black mask surface layer 102A.

Fourth Embodiment

Figure 14A:
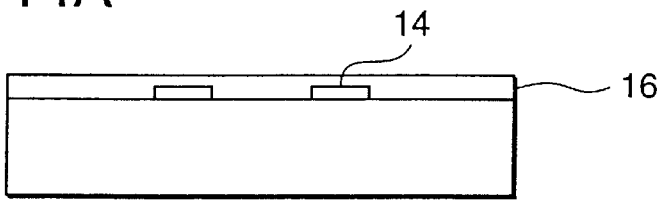
FIGS. 14A to 14E are cross-sectional views showing processes of a barrier rib forming method according to a fourth embodiment of the present invention.
Figure 14C:
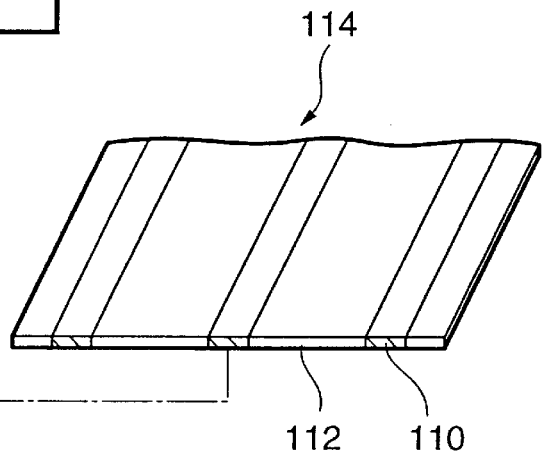
Figure 14B:
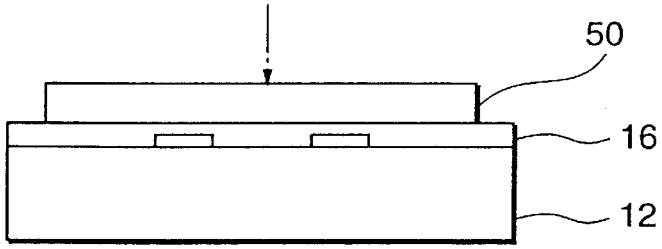
Figure 14D:
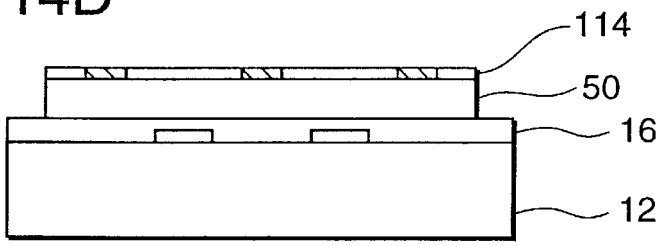
Figure 14E:
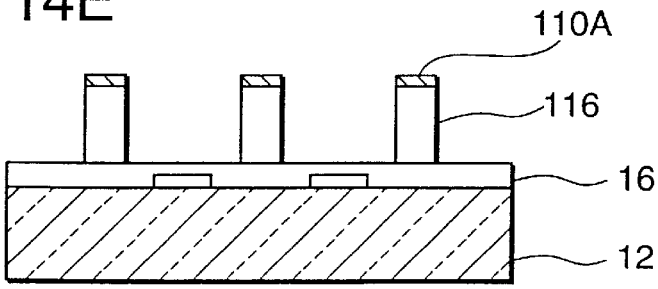

FIGS. 14A to 14E are cross-sectional views for explaining a barrier rib forming process according to a fourth embodiment of the present invention. According to the present embodiment, the white rib material layer 50 is formed (FIG. 14B) on the glass substrate 12 with the electrodes (FIG. 14A). On the other hand, a stripe sheet 114 formed by alternately arranging a black rib material 110 and a white rib material 112 is prepared (FIG. 14C). The sheet 114 is laminated on the crib material layer 50 on the glass substrate 12 (FIG. 14D). The roller 54 is rolled to form embossed lines (pre-ribs) 116.

The black rib material 110 of the stripe sheet 114 is arranged on the position of each of the ribs 18 which are formed at regular intervals. When the stripe sheet 114 is laminated on the rib material layer 50, position alignment is performed so that the black rib material 110 corresponds to each groove 80 (refer to FIGS. 4 to 8) of the roller 54. Consequently, the black rib material 110 becomes a layer 110A covering the top surface of each embossed line 116. The layer 110A serves as a black surface mask.

Fifth Embodiment

Figure 15A:
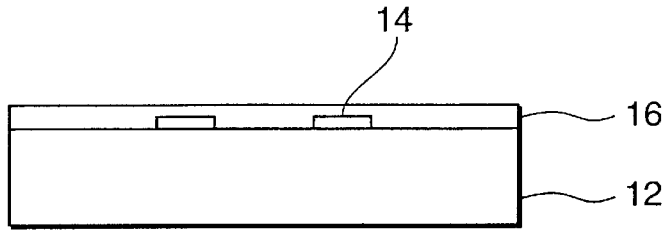
FIGS. 15A to 15E are cross-sectional views showing processes of a barrier rib forming method according to a fifth embodiment of the present invention.
Figure 15B:
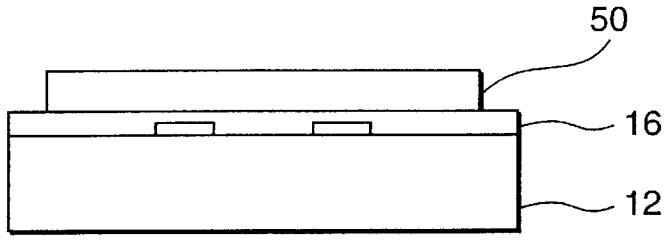
Figure 15C:
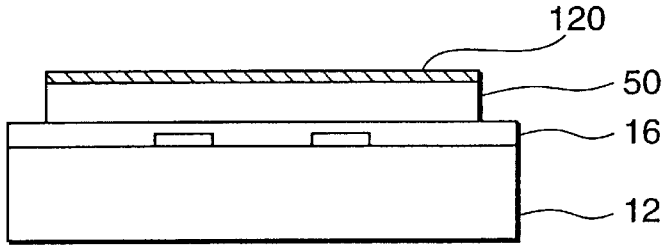

FIGS. 15A to 15E are cross-sectional views for explaining a barrier rib forming process according to the fifth embodiment of the present invention. According to the fifth embodiment, a photosensitive black rib material is used and the black rib material is formed on the top surface alone of each embossed line (pre-rib) by using the photolithography method. That is, the rib material layer 50 is formed (FIG. 15B) on the glass substrate 12 with the electrodes (FIG. 15A). A photosensitive black rib material 120 is applied to it at a uniform thickness (FIG. 15C).

Figure 15D:
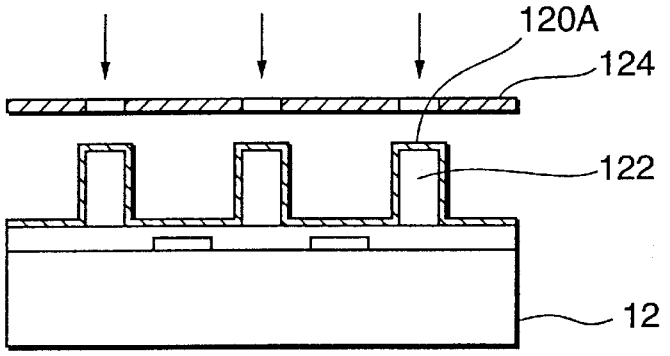
Figure 15E:
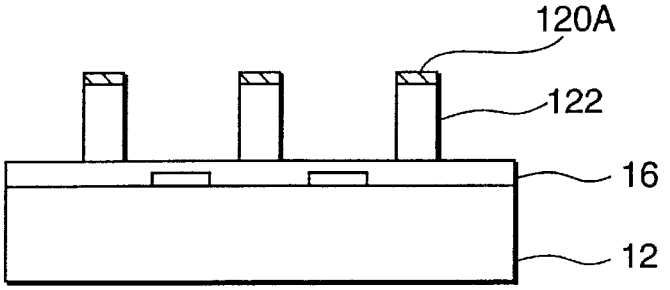

When the roller 54 is rolled on the resultant one, the white glass paste of the rib material layer 50 is gathered into the grooves 20 (refer to FIGS. 4 to 8) of the roller 54 to form embossed lines (pre-ribs) 122. At this time, a thin layer made of the white glass paste of the rib material layer 50 and the black rib material 120 is remained between the embossed pre-ribs 122. A thin layer made of the black rib material 120 is also remained on both sides of each embossed line 122. Subsequently, the surface is exposed by ultraviolet rays through a photomask 124, so that a black rib material 120A alone on positions each corresponding to the top face of the rib is developed to be hardened (FIG. 15D). Removing the other uncured black rib material 120 enables the embossed pre-ribs 122 made of the white rib material having the black rib material 120A thereon to be formed as shown in FIG. 15E.

Sixth Embodiment

Filing of Phosphor to Discharge Cell

Figure 16:
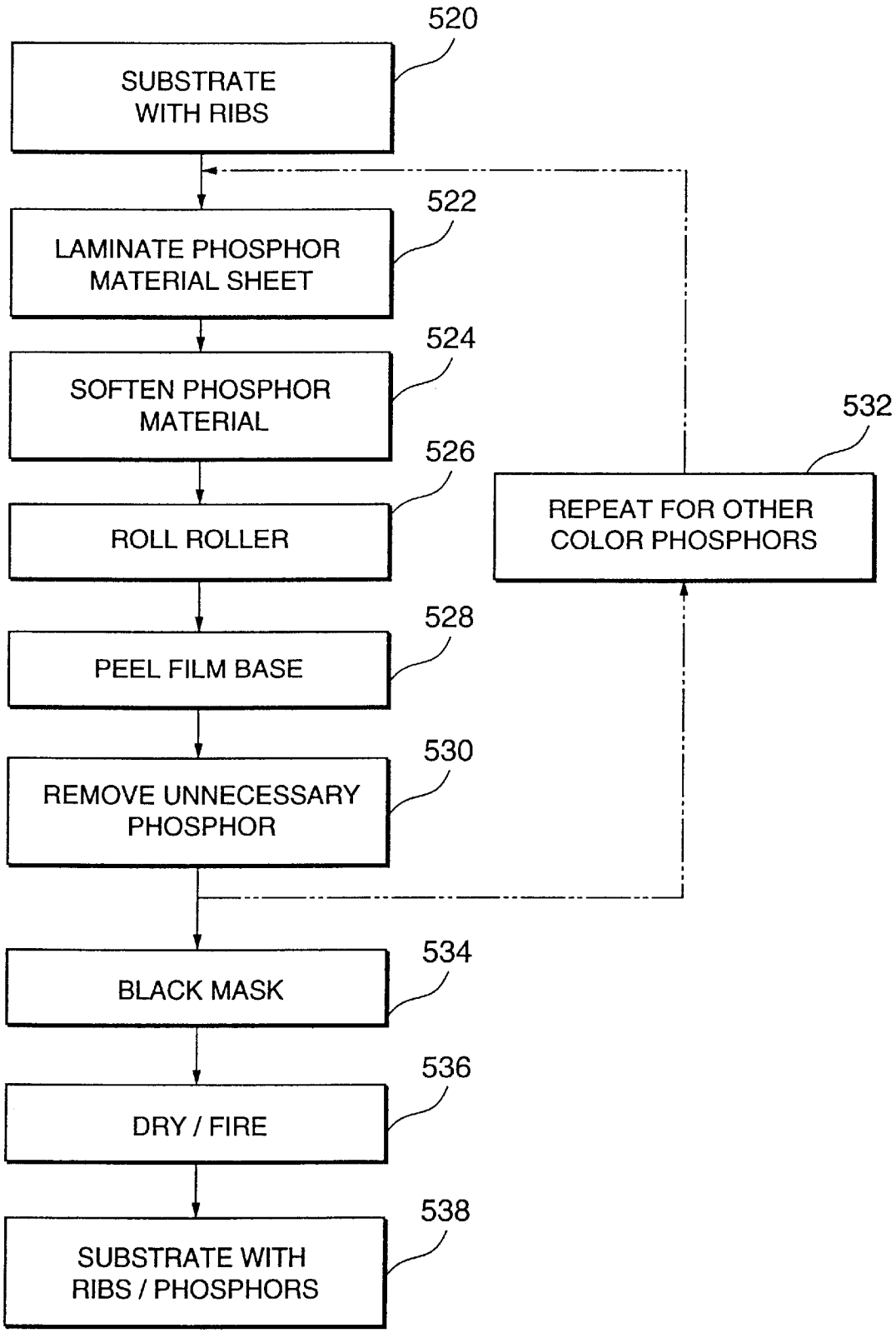
FIG. 16 is a flowchart of a method of filling phosphor into discharge cells according to a sixth embodiment of the present invention.

A method of filling-the phosphor 22 to grooves between the ribs 18, i.e., the discharge cells 20 will now be explained with reference to FIGS. 16 and 17A to 17H. FIG. 16 is a flowchart of the phosphor filling method. FIGS. 17A to 17H are cross-sectional views for explaining processing steps.

First, the glass substrate 12 on which the barrier ribs 18 are formed by the method shown in FIGS. 9 and 10A to 10D (first embodiment) is prepared (step 520 in FIG. 16). A phosphor material sheet 130 is laminated on the glass substrate 12 so that the surface having the ribs 18 thereon is set upwardly (step 522). The phosphor material sheet 130 is obtained by coating a film base 132 with a phosphor material paste 134 at a uniform thickness. A thermoplastic resin layer or a release resin layer may be sandwiched between the film base 132 and the phosphor material paste 134.

In this case, since it is a first process, for example, a red (R) phosphor material sheet 130R is used. In order to adjust the hardness of the phosphor material paste 134 (in this case, a red phosphor material paste 134R), the glass substrate 12 is set in a solvent vapor of the phosphor material paste 134 and is left for a predetermined period of time (step 524). When the support film 132 has no permeability to the solvent vapor or gas, the phosphor material sheet 130 is set in the solvent vapor before the lamination and is softened and, after that, the phosphor material sheet 130 may be laminated on the glass substrate 12.

Figure 17A:
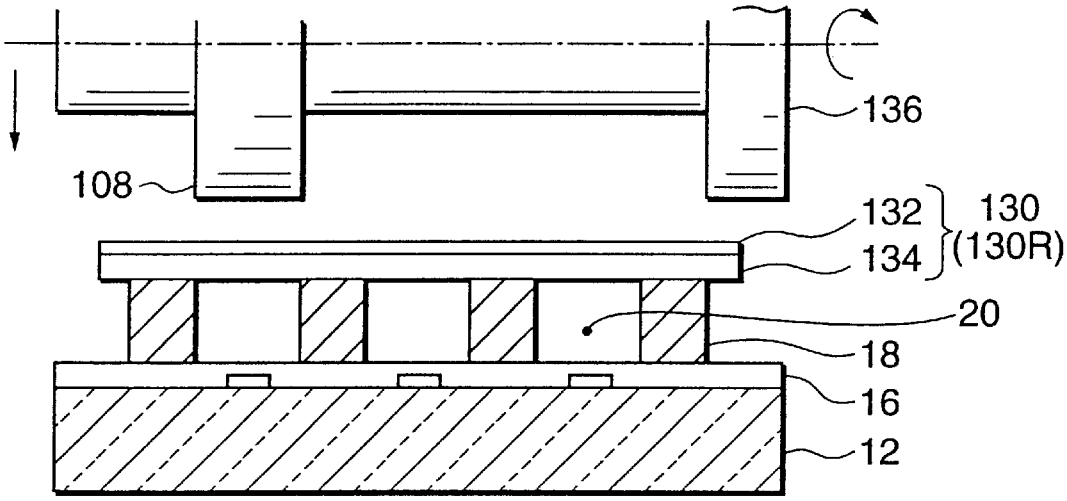
FIGS. 17A to 17E are cross-sectional views for explaining processing steps of the method of filling phosphor into the discharge cells according to the sixth embodiment of the present invention.
Figure 17B:
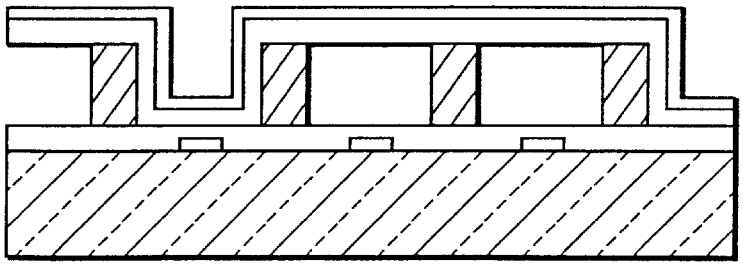

Subsequently, a phosphor filling roller 136 is rolled on the phosphor material sheet 130R by using the apparatus explained in FIG. 2 (FIG. 17A, step 526). The roller 136 has embossed or protruding portions 138 on positions corresponding to the grooves 20 which will be filled with the red phosphor of the phosphor material sheet 130R. The section of the embossed portion 138 is slightly smaller than the section of the groove 20. According to the present embodiment, since three color phosphors of R, G, and B for color display are used, a lot of protruding portions 138 of the roller 136 are formed at three pitches of the grooves 20.

Consequently, the phosphor material sheet 130R is inserted to the grooves (discharge cells) 20 corresponding to the red pixels by the protruding portions 138. The phosphor material paste 134R is adhered to the internal surface of each corresponding groove 20. When the thermoplastic resin is sandwiched in the phosphor material sheet 130, the pressurized thermoplastic resin is softened by rolling the roller 136, so that the phosphor material paste 134R is easily separated away from the film base 132, adhered to the inside of the grooves 20, and remained.

Figure 17C:
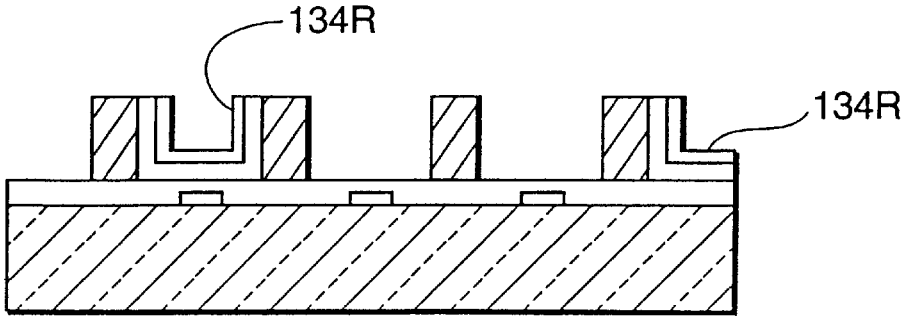

Therefore, when the film base 132 is peeled off (step 528), the unnecessary phosphor material paste 134R which does not remain in the groove 20 is adhered to the film base 132 and removed together with the film base 132. In the case where the phosphor material sheet 130 sandwiching the release resin layer therein is used, when the film base 132 is peeled off (step 528), the phosphor material paste 134R is removed to adhere and remain not only in the grooves 20 but also on the ribs 18. In this case, the glass substrate 12 is reversed upside down and the phosphor material paste 134R adhered on the top faces of the ribs 18 are scraped off from the lower side by a knife edge (step 530). FIG. 17C shows a state where the unnecessary phosphor material paste 134R has been eliminated in this manner.

Figure 17D:
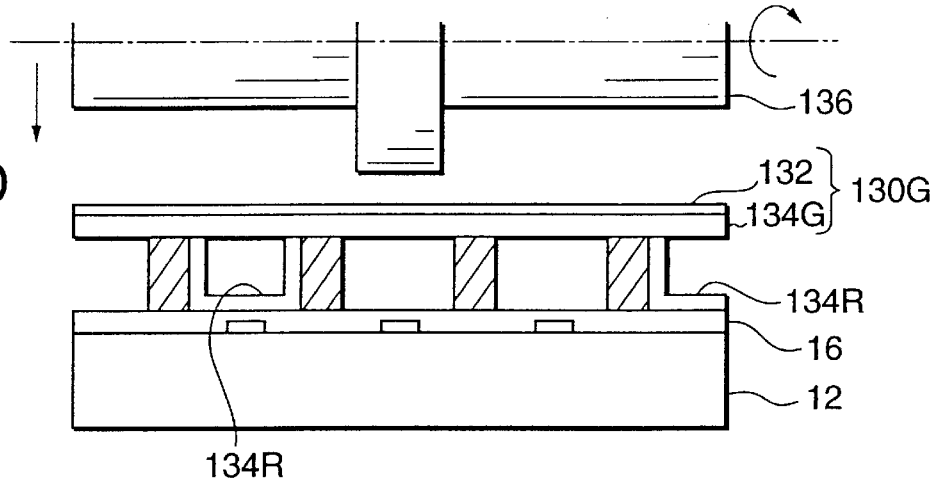
Figure 17E:
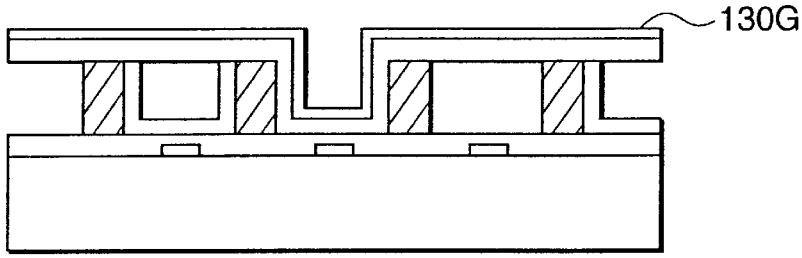

The similar process is repeated for each of other color phosphor material sheets 130G and 130B (not shown) (step 532). More specifically, when the phosphor material sheet 130R of R (red) is used first time, for example, the phosphor material sheet 130G of G (green) is used second time as shown in FIG. 17D and the phosphor material sheet 130B of B (blue) is used third time (not shown). As for the roller 136 of FIG. 17D, which is used for the second G phosphor material sheet 130G, the roller 136 used in the first time shown in FIG. 17A can be used by deviating by one pitch in the axial direction (width direction).

Figure 17F:
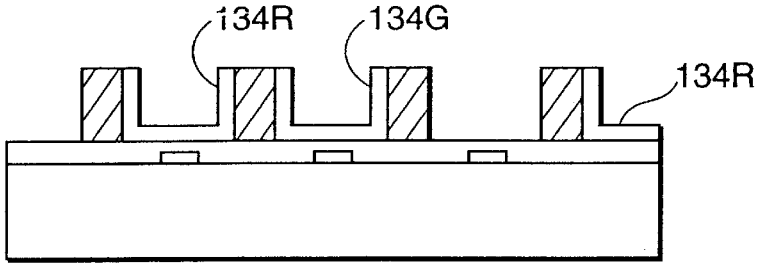
Figure 17G:
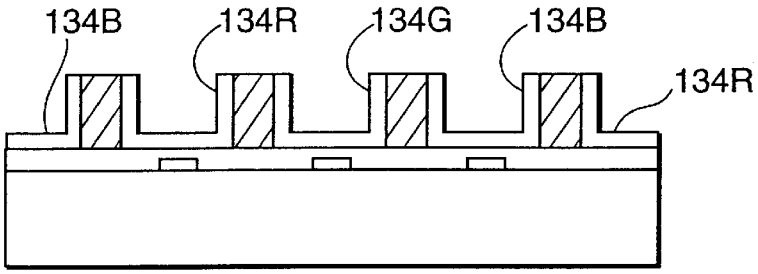

FIGS. 17D to 17H show states where the grooves adjacent to the grooves filled with the R phosphor material paste 134R are filled with the G phosphor material sheet 130G in this manner. FIG. 17F shows a state where the unnecessary G phosphor material paste 134G has been removed. For the third B (blue) phosphor material sheet, the roller 136 is used by further deviating by one pitch in the same direction. FIG. 17G shows a state where the unnecessary B phosphor material paste 134B has been eliminated.

Figure 17H:
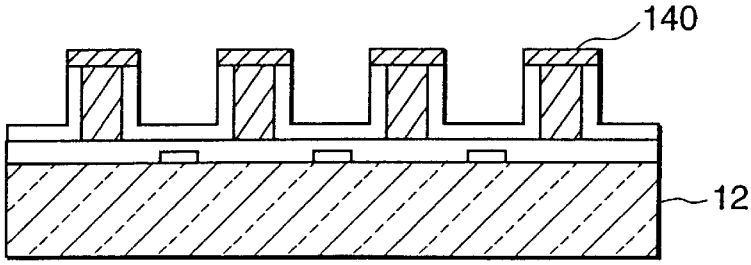

After all of the grooves 20 are filled with the predetermined color phosphor material pastes 134 as mentioned above, a black anti-reflection layer (black mask) 140 is formed on the top face of each rib 18 (step 534). The resultant materials are dried and fired (step 536). Consequently, the substrate 12 with the ribs and phosphors shown in FIG. 17H is obtained (step 538). The black anti-reflection layer 140 serving as a black mask can be formed in such a manner that., for example, a black dielectric liquid is applied by the screen printing and is dried.

As mentioned above, according to the sixth embodiment of the present invention, the embossed lines corresponding to the barrier ribs are formed by rolling the rib forming roller on the uncured barrier rib material layer, the embossed lines (pri-ribs) are dried and fired to form the barrier ribs on the glass substrate, and after that, the phosphor filling roller is rolled on the phosphor material sheet laminated on the formed barrier ribs to fill the phosphor material paste into the predetermined discharge cells. The phosphor can be efficiently applied to the side wall of the barrier ribs and filled into the discharge cell by rolling the roller. consequently, the discharge cell with the phosphor can be formed with high precision, so that the method is suitable for realizing the high definition and the large size of the PDP.

The number of processing steps is reduced, so that the small size and small scale of the manufacturing apparatus can be realized. Further, since the phosphor material is efficiently filled between the barrier ribs by rolling the roller, the loss of the phosphor material is not generated. Since the number of processing steps is small, a yield upon manufacturing is raised. Since the unnecessary phosphor material paste remained on the top surface of the barrier rib can be removed by a blade or the like, expensive phosphor can be easily recovered and reused. Consequently, the manufacturing cost can be sharply reduced.

Seventh Embodiment

Figure 18:
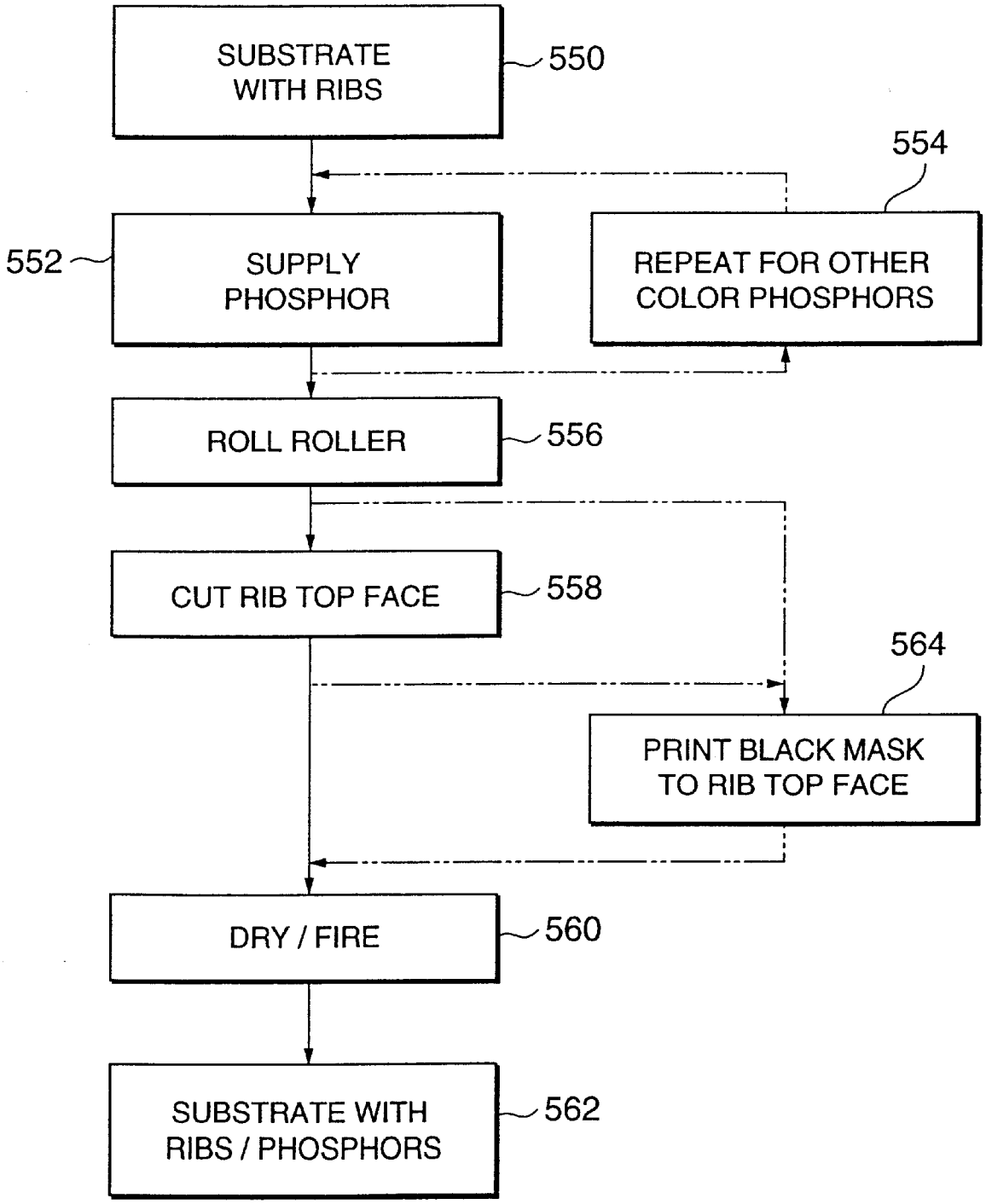
FIG. 18 is a flowchart of a method of filling phosphor into discharge cells according to a seventh embodiment of the present invention.

FIG. 18 is a flowchart of a discharge cell forming process according to a seventh embodiment of the present invention. FIGS. 19A to 19E are cross-sectional views for explaining processing steps. According to the present embodiment, the glass substrate 12 on which the ribs 18 have previously been formed is prepared (step 550 in FIG. 18, FIG. 19A). A predetermined color phosphor material paste 150 (150R, 150G, 150B) is supplied to the grooves 20 between the ribs 18 (step 552).

Figure 19A:
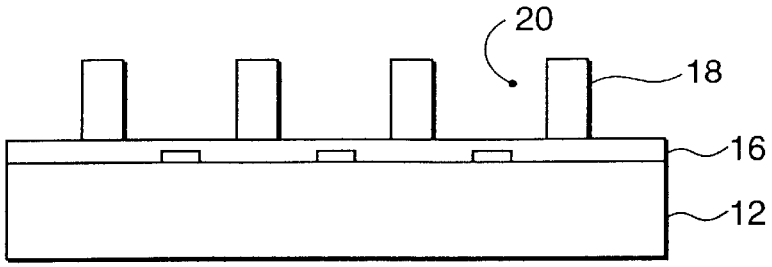
FIGS. 19A to 19E are cross-sectional views for explaining processing steps of the method of filling phosphor into the discharge cells according to the seventh embodiment the present invention.
Figure 19B:
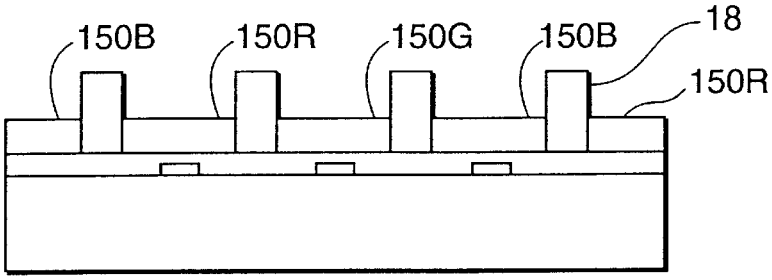

The phosphor material paste 150 is supplied in such a manner that in case of, for example, the read phosphor material paste 150R, a screen mask having openings on positions to supply the red phosphor material paste 15OR is superposed on the glass substrate 12 and the red phosphor material paste 150R is printed. Similarly, the process of changing the screen mask and supplying the phosphor material paste 150 to the predetermined grooves 20 is repeated for each of the green and blue phosphor material pastes 150G and 150B (step 554). FIG. 19B shows a state where the corresponding color phosphor material pastes 150 have been supplied to all of the grooves 20 in this manner.

Figure 19C:
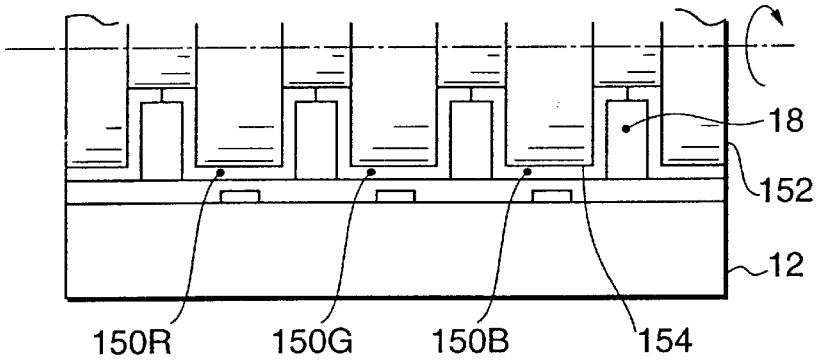

A phosphor filling roller 152 is rolled on the glass substrate 12 by using the apparatus shown in FIG. 2 (step 556). The roller 152 has embossed or protruding portions 154 whose form in section is slightly smaller than that of the groove 20 between the ribs 18. ordinarily, the rib forming roller 54 (refer to FIG. 10C) can be used. The phosphor material paste 150 in each groove 20 is adhered to the internal surface of the. groove 20 by rolling the phosphor filling roller 152, so that the excess phosphor material paste 150 gathers to the top face of each rib 18 (FIG. 19C).

At that time, a gap between the roller 152 and the glass substrate 12 is controlled to a predetermined dimension by a proper method. In order to improve the release properties of the phosphor material paste 150 to the roller 152, it is desirable to apply a release agent to the phosphor material paste 150 side or roller 152 side, or both of the sides by spraying. In order to adjust the hardness of the phosphor material paste 150, it may be dried for a proper period of time or may be left in the solvent vapor for a predetermined period of time. That is, although it is necessary that the phosphor material paste 150 to be supplied in step 552 has enough flowability, the phosphor material paste 150 requires proper hardness when the roller 152 is rolled because the proper hardness is varied every step. It is preferable that the amount of the phosphor material paste 150 to be supplied in step 552 be set enough.

As mentioned above, after the phosphor material paste 150 is filled by the roller 152, the unnecessary phosphor material paste 150 overflowed on the top face of the rib 18 is scraped off by applying a knife edge or the like to the top face of the rib 18 (step 558), the paste is dried and fired (step 560), so that the glass substrate 12 with the ribs and phosphor can be obtained (step 562).

Figure 19D:
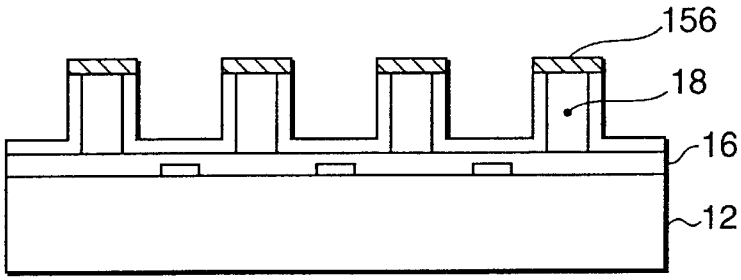
Figure 19E:
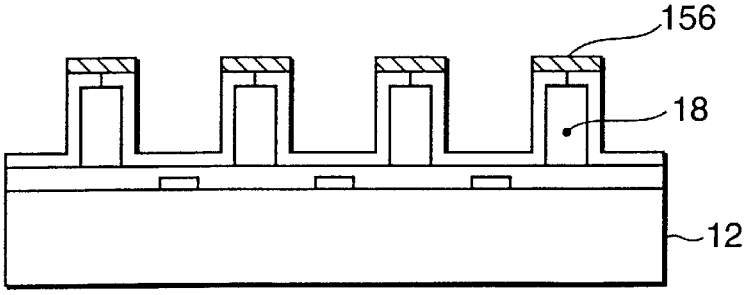

A black anti-reflection layer 156 serving as a black mask may be formed on the top face of each rib 18. In this case, after the unnecessary phosphor material paste 150 adhered on the top face of the rib 18 is scraped off by the knife edge, the black anti-reflection layer 156 can be applied by the screen printing or the like (FIG. 19D). The black anti-reflection layer 156 may also be applied so as to be superposed on the unnecessary phosphor material paste 150 adhered on the top face of each rib. FIG. 19E). In this case, the cutting process of the rib top face in step 558 can be omitted.

Eighth Embodiment

Figure 20A:
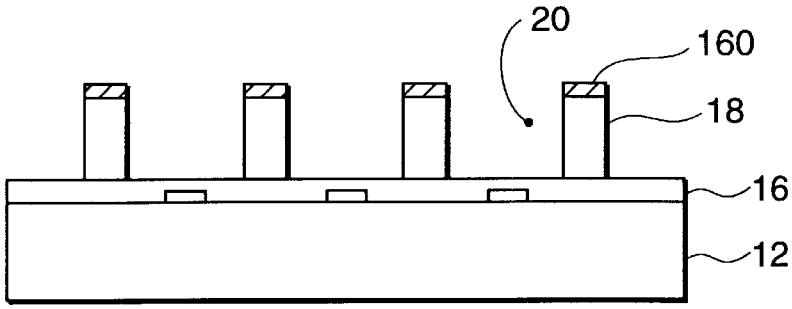
FIGS. 20A to 20C are cross-sectional views for explaining processing steps of the method of filling phosphor into the discharge cells according to an eighth embodiment of the present invention.
Figure 20B:
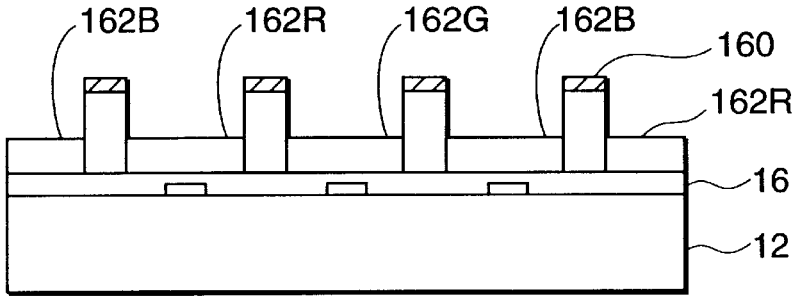
Figure 20C:
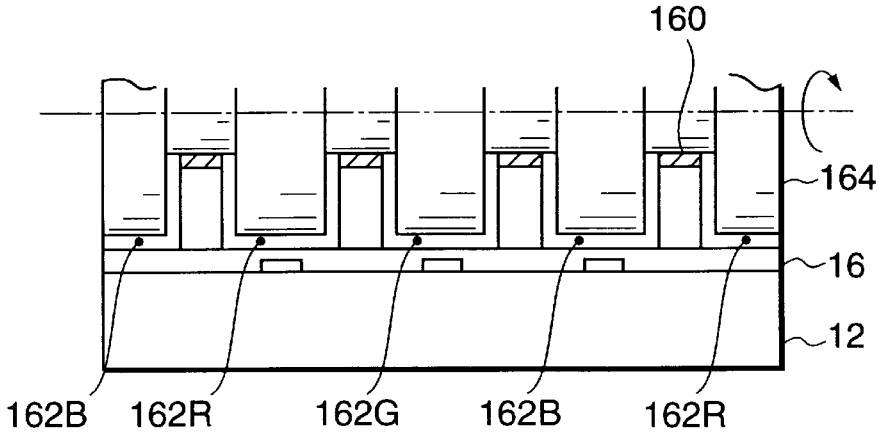

FIGS. 20A to 20C are cross-sectional views for explaining a discharge cell forming process according to an eighth embodiment of the present invention. According to the eighth embodiment, the glass substrate 12 having the ribs 18 thereon is prepared and a black anti-reflection layer 160 serving as a black mask is applied to the top face of each rib 18 by the screen printing or the like (FIG. 20A).

In a manner similar to the seventh embodiment described in FIGS. 14A to 14E and 15A to 15E, a predetermined color phosphor material paste 162 (162R, 162G, 162B) is supplied to the grooves 20 between the ribs 18 (FIG. 20B). After that, a phosphor filling roller 164 is rolled on the substrate by using the apparatus shown in FIG. 2 to allow the phosphor material paste 162 to adhere onto the internal surface of each groove 20 (FIG. 20C). As for the roller 164 which is used in this case, the rib forming roller 54 (FIG. 10C) can be used.

When the rib forming roller 54 is used as mentioned above, the amount of shrinkage of the rib 18 upon firing becomes the thickness of the phosphor material paste 162. In order to maintain the enough thickness of the phosphor material paste 162, therefore it is necessary to determine a composition (proportion of the glass powder to the binder) of the rib material. In order to prevent the phosphor material paste 162 in the groove 20 from overflowing due to rolling the roller 164, it is preferable to adjust the supply of the phosphor material paste 162, pressing force of the roller 164, or distance between the roller 164 and the substrate 12.

As mentioned above, according to the seventh and eighth embodiments of the present invention, since the phosphor material paste is supplied to the discharge cells between the ribs formed on the glass substrate by the screen printing and the phosphor material paste is filled into the discharge cells by rolling the phosphor filling roller, waste of the phosphor material paste is not generated. Since the rolling process of the phosphor filling roller is completed once, the productivity is further improved.

Ninth embodiment

Formation of Barrier Rib and Filling of Phosphor

Figure 21:
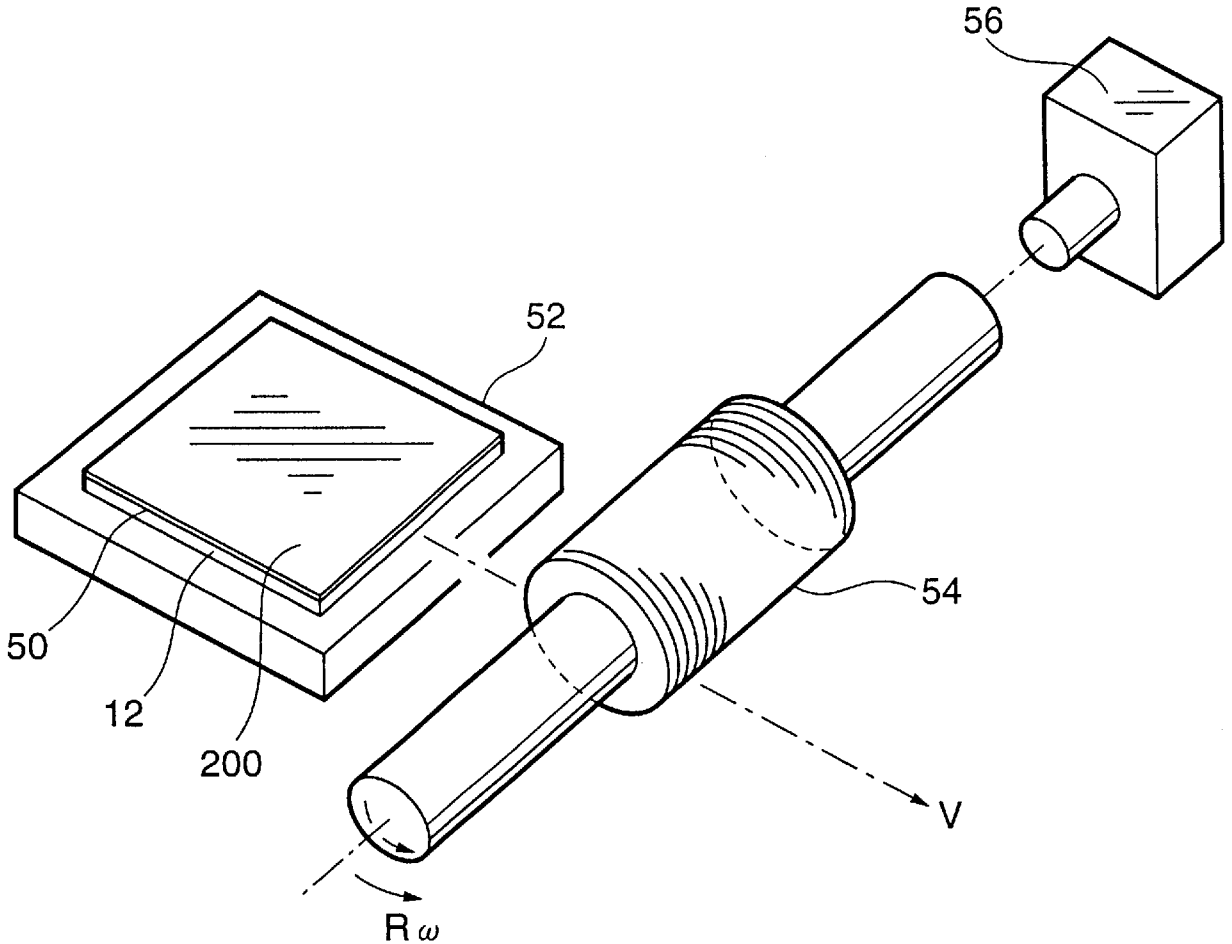
FIG. 21 is a principle explanatory diagram of a method of forming discharge cells for a PDP according to the present invention.

According to a ninth embodiment of the present invention, a method of forming the discharge cells 20 by simultaneously forming the barrier ribs 18 on the rear glass substrate 12 and filling the phosphor 22 will now be described by referring to FIGS. 21 to 23A to 23G. According to the ninth embodiment, as shown in FIG. 21, the rib material layer 50 and a phosphor material layer 200 are formed on the glass substrate 12 on which the electrodes 14 have previously been formed and which has been covered with the dielectric layer 16. The substrate is held on the carrying table 52 and moved. The roller 54 disposed in the direction perpendicular to the moving direction of the carrying table 52 is rolled on the rib material layer 50 and phosphor material layer 200, so that the groove pattern formed on the roller 54 is transferred to the rib material layer 50 and the phosphor material layer 200. The barrier ribs 18 and phosphor 20 are simultaneously formed by drying and firing.

The roller 54 in FIG. 21 is rotated by the motor 56 in a manner similar to the first to eighth embodiments. The peripheral velocity of the roller 54 is made to coincide with the carrying speed V of the substrate 12. That is, when it is assumed that the radius (e.g. a mean value of the radius of the outermost periphery and the radius of the periphery corresponding to the bottoms of the grooves) of the roller 54 is set to R and the rotational angle speed is set to ω (radian/sec), the roller is rotated so as to satisfy the following equation.

$$R\omega = V$$

The apparatus for embodying the method can be formed with the same construction as that of the apparatus in the first embodiment described with reference to FIGS. 2 to 8.

Figure 22:
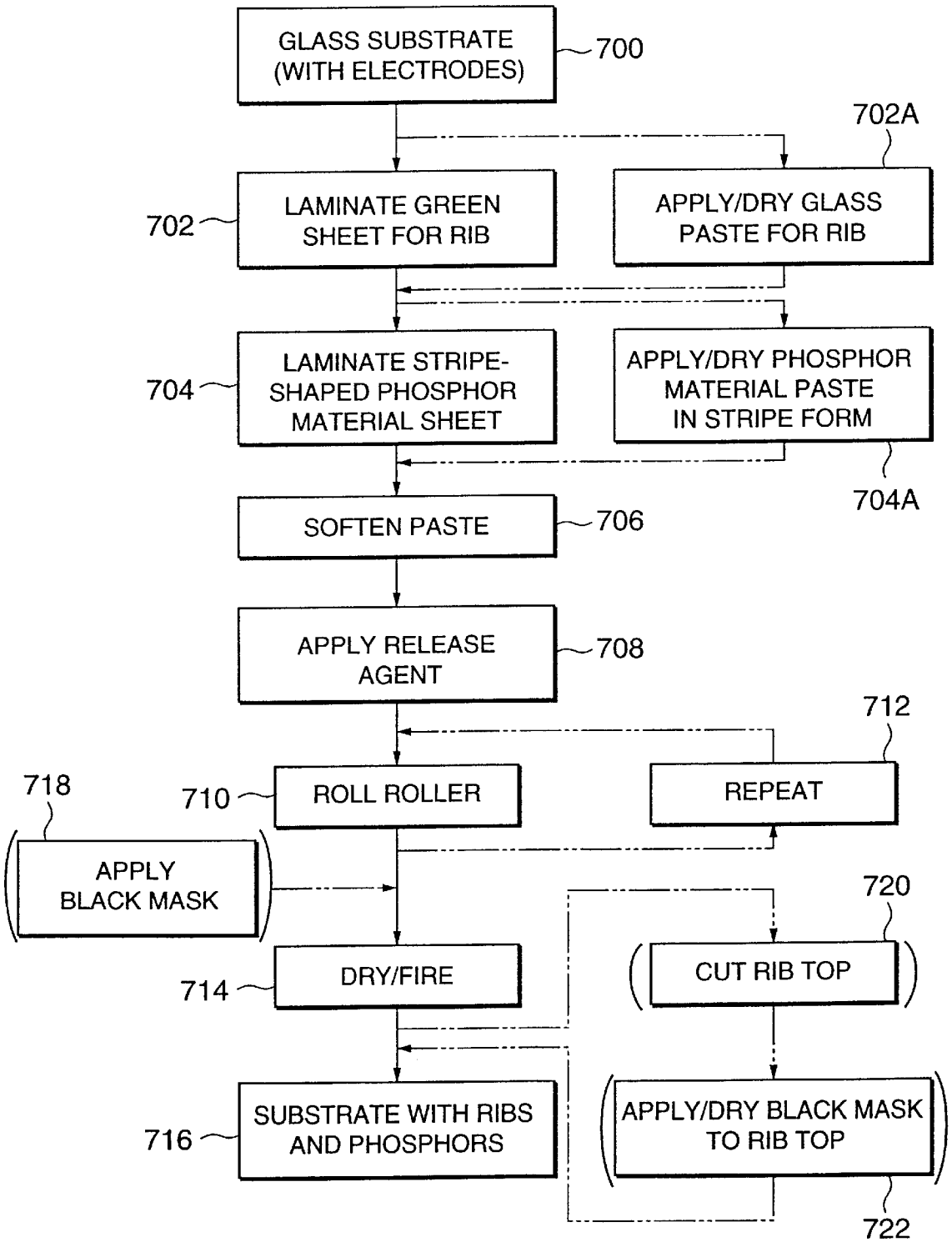
FIG. 22 is a flowchart of a method of forming discharge cells (barrier ribs with phosphor) according to a ninth embodiment of the present invention.
Figure 23A:
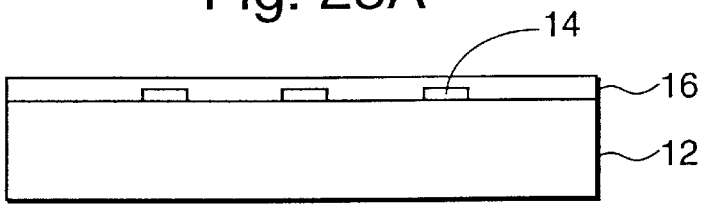
FIGS. 23A to 23G are cross-sectional views for explaining processing steps of the discharge cell forming method according to the ninth embodiment of the present invention.
Figure 23B:
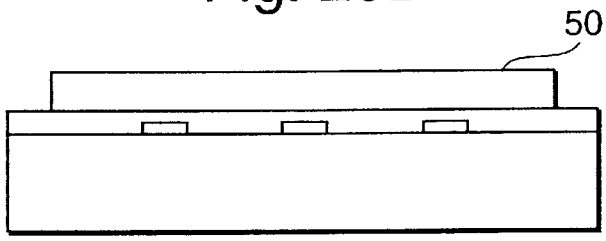

A discharge cell forming process will now be described with reference to FIGS. 22 and 23A to 23G. FIG. 22 is a flowchart of the process. FIGS. 23A to 23G are cross-sectional views for explaining processing steps. As described above, the rear glass substrate 12 on which the electrodes 14 and the rear dielectric layer 16 are formed is prepared (step 700 in FIG. 22). FIG. 23A shows the glass substrate 12. The rib material layer 50 (refer to FIGS. 2 and 3) is formed on the surface of the glass substrate 12 (step 702) as shown in FIG. 23B.

As a method of forming the rib material layer 50, a method of laminating the green sheet for rib explained in the first embodiment on the surface of the glass substrate 12 has good working properties and the method is convenient to form a uniform thickness. The green sheet is made by sandwiching a glass paste for rib in a sheet form having a uniform thickness between protective sheets. The green sheet is used in such a manner that one of the protective sheets is peeled off, the green sheet is adhered to the glass substrate 12, and the other protective sheet is peeled off just before rolling the roller, which will be described herein later. A liquid glass paste for rib is applied to the glass substrate 12 at a uniform thickness and dried and the resultant layer can be used in place of the green sheet (step 702A).

For the glass paste for rib which is used in this case, the same one as the paste described in the first embodiment can be used.

Figure 23C:
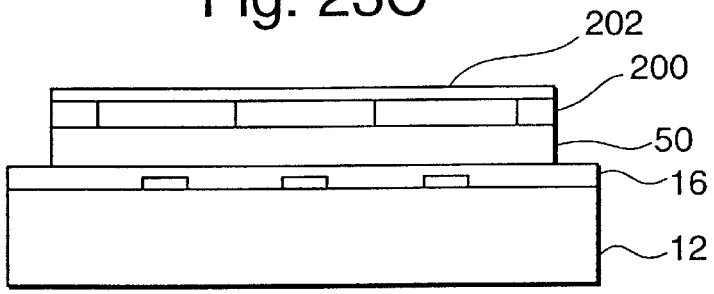

The phosphor material layer 200 is formed on the rib material layer 50 as shown in FIG. 23C. The phosphor material layer 200 is made by forming respective color phosphor material pastes (phosphor material paste) of R, G, and B in a stripe form at regular intervals corresponding to the barrier ribs 18. A phosphor material sheet previously prepared can be laminated on the layer 200 (step 704). In place of the phosphor material sheet, a phosphor material paste may be applied in a stripe form by the printing and dried (step 704A). The phosphor material paste which is used in this case has substantially the same composition and physical properties as those of the glass paste for rib described in the first embodiment. The paste is made by using a phosphor material powder (grain diameter is equal to 3 to 5 $\mu$m) in place of the glass powder.

The glass substrate 12 on which the rib material layer 50 and phosphor material layer 200 are formed as mentioned above is left in the solvent vapor for a predetermined period of time to soften the rib material layer 50 and the phosphor material layer 200, so that working properties by the roller 54 are improved (step 706). A release agent 202 (refer to FIG. 23C) is applied to the surface of the phosphor material layer 200 by spraying (step 708) and, after that, the roller 54 is rolled (step 710).

Figure 23D:
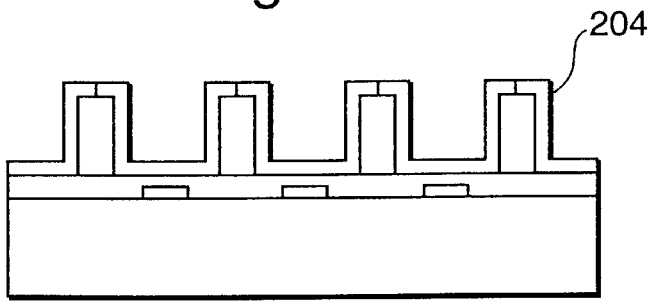
Figure 23F:
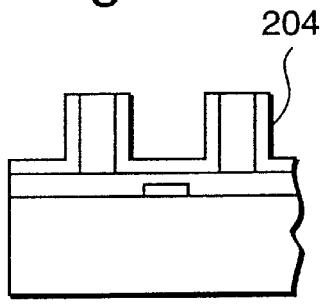

Since the groove pattern has been formed on the roller 54, the rib material and phosphor material flow and gather into the grooves 80 (80A to 80C, refer to FIGS. 4 to 8) of the groove pattern, thereby forming embossed lines (pre-ribs) 204 whose form in section coincides with that of the groove 80 on the roller 54 as shown in FIG. 23D. When the flowability of the rib material is set so as to be larger than that of the phosphor material in this instance, the rib material can be smoothly gathered into the grooves 80 of the roller 54 while the phosphor material is remained between the neighboring grooves 80.

Although the roller 54 is rolled only once, it can also be reciprocatingly moved on the same path (passage once or plural times (step 712). Since the release agent is applied to the phosphor material layer 200, the rib material or phosphor material does not adhere to the roller 54. The release agent 202 can be applied to the surface of the roller 54 and it can also be applied to both of the roller 54 and the phosphor material layer 200. The total thickness of the rib material layer 50 and the phosphor material layer 200 should be determined in consideration of the sectional area of the groove 80 of the roller 54. The sectional area of the groove 80 should be determined so that the form of the embossed pre-ribs 204 after firing becomes the rib 18 having desired height and width in consideration of the amount of shrinkage of the rib material after firing.

After the embossed pre-ribs 204 are formed by rolling the roller 54, the glass substrate 12 is sequentially carried into the drying furnace and the firing furnace (step 714). Drying and firing may also be performed in such a manner that the same furnace is used as a drying furnace and a firing furnace and a temperature in the furnace is sequentially raised in accordance with a preset program. In this instance, the rib material and phosphor material constructing the embossed pre-ribs 204 are dried and further fired, so that the glass substrate with the barrier ribs 18 and phosphor 22 is obtained (FIG. 23D, step 716 in FIG. 22).

Figure 23E:
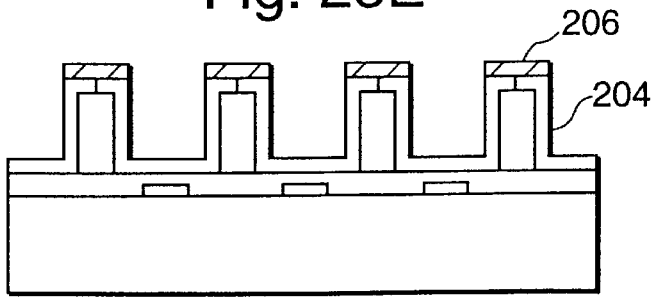

Prior to firing the rib material 50 and phosphor material 200, when a black anti-reflection layer 206, for example, a black dielectric liquid can be applied to the top face of each embossed line 204 by the printing (FIG. 23E, step 718 in FIG. 22). In this manner, the black anti-reflection layer 206 serving as a black mask can be formed by firing together with the rib material 50 and phosphor material 200 in a lump, so that the firing process can be simplified.

Figure 23G:
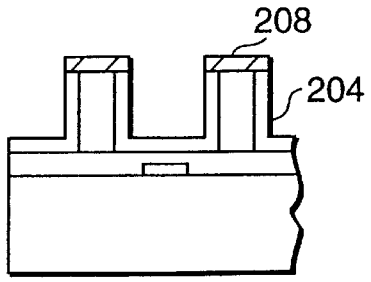

In place of applying the black anti-reflection layer 206 to the phosphor material 200, after the rib material 50 and phosphor material 200 are fired (step 714), the top face of the rib 18 is cut off (FIG. 23F, step 720), the unnecessary phosphor material 200 on the top face is removed, and after that, a black anti-reflection layer 208 as a black surface mask may be applied to the top face (FIG. 23G, step 722).

As mentioned above, according to the ninth embodiment of the present invention, the uncured barrier rib material layer having flexibility is formed on the glass substrate, the phosphor material layer is laminated to the barrier rib material layer, and the roller on which the groove pattern corresponding to the barrier ribs has been formed is rolled on the barrier rib material layer and phosphor material layer. Consequently, the embossed pre-ribs corresponding to the barrier ribs are formed and the phosphor material can be supplied to the wall surfaces of each rib and the inside of the discharge cell. Therefore, the barrier ribs with the phosphor, that is, the discharge cells with the phosphor can be formed with high precision. The method is suitable for realizing the high definition and large size of the PDP.

Since the number of processing steps is reduced and, particularly, single firing step can form the barrier ribs with phosphor, the small size and small scale of the manufacturing apparatus can be realized. Further, since all of the material for the barrier rib material layer formed on the glass substrate is gathered to the embossed banks and used as barrier ribs and all of the phosphor material is used, the loss of each of the barrier rib material and the phosphor material is not generated and the number of processing steps is small, so that a yield upon manufacturing is raised and the manufacturing cost can be sharply reduced.

Tenth Embodiment

FIGS. 24A to 24D are views for explaining processing steps in a tenth embodiment of the present invention. According to the present embodiment, a black anti-reflection layer, i.e., a black mask is formed on each barrier rib simultaneously with the formation of the barrier ribs and phosphor.

Figure 24A:
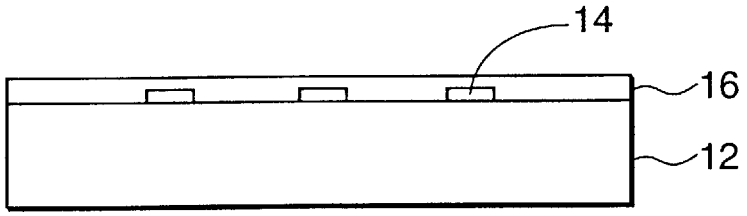
FIGS. 24A to 24D are cross-sectional views for explaining processing steps of the discharge cell forming method according to a tenth embodiment of the present invention.
Figure 24B:
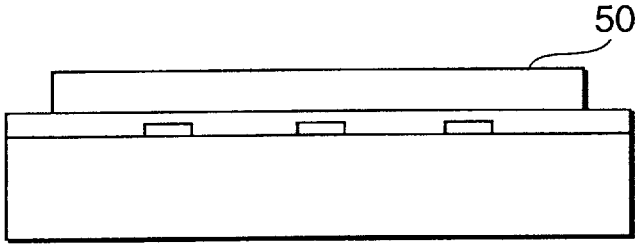
Figure 24C:
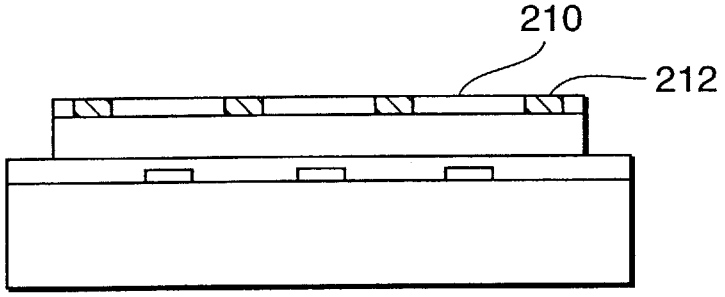

First, the rear glass substrate 12 on which the electrodes 14 and the rear dielectric layer 16 are formed is prepared (FIG. 24A). A glass paste for rib is applied to the glass substrate 12 and is dried to form the rib material layer 50 (FIG. 24B). A green sheet made of the glass paste can be laminated on the surface of the glass substrate 12 instead of applying and drying the glass paste. A phosphor material layer 210 is formed on the rib material layer 50 formed as mentioned above (FIG. 24C). The phosphor material layer 210 includes a black anti-reflection material 212 on positions corresponding to the ribs 18.

The phosphor material layer 210 can be formed by applying, for example, different color phosphor materials and the black anti-reflection material in a stripe formed by e.g. the printing. In place of the printing, a sheet made by previously arranging the phosphor materials and the black anti-reflection material to predetermined positions is prepared and the sheet may be laminated on the rib material layer 50.

Figure 24D:
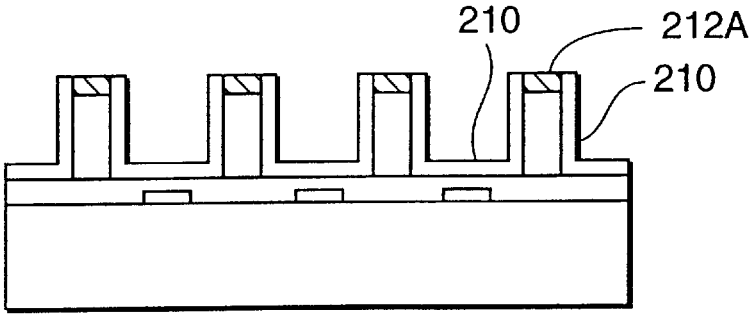

Similar to the process shown in FIGS. 22 and 23A to 23G, the paste softening process (step 706) and release agent applying (step 708) are performed and the roller 54 is rolled (steps-710 and 712). Consequently, the embossed lines 210 are formed as shown in FIG. 24D. A layer 212A obtained by applying the black anti-reflection material 212 is formed on the top face of each embossed line 210. The roller 54 is reciprocatingly moved as necessary (step 712) and the formed slayer is dried and fired (step 714), so that the glass substrate 12 with the ribs and phosphor can be obtained (step 716). The rib has the black mask thereon.

According to the tenth embodiment, since the black anti-reflection material is formed on the phosphor material layer so as to correspond to each rib, and since the black mask pattern is simultaneously formed on the rib top face in the barrier rib forming process, a process of a black matrix which is used to be formed on the front glass substrate in the conventional method is unneeded or simplified, so that the productivity of the PDP is further improved.

Eleventh Embodiment

Figure 25:
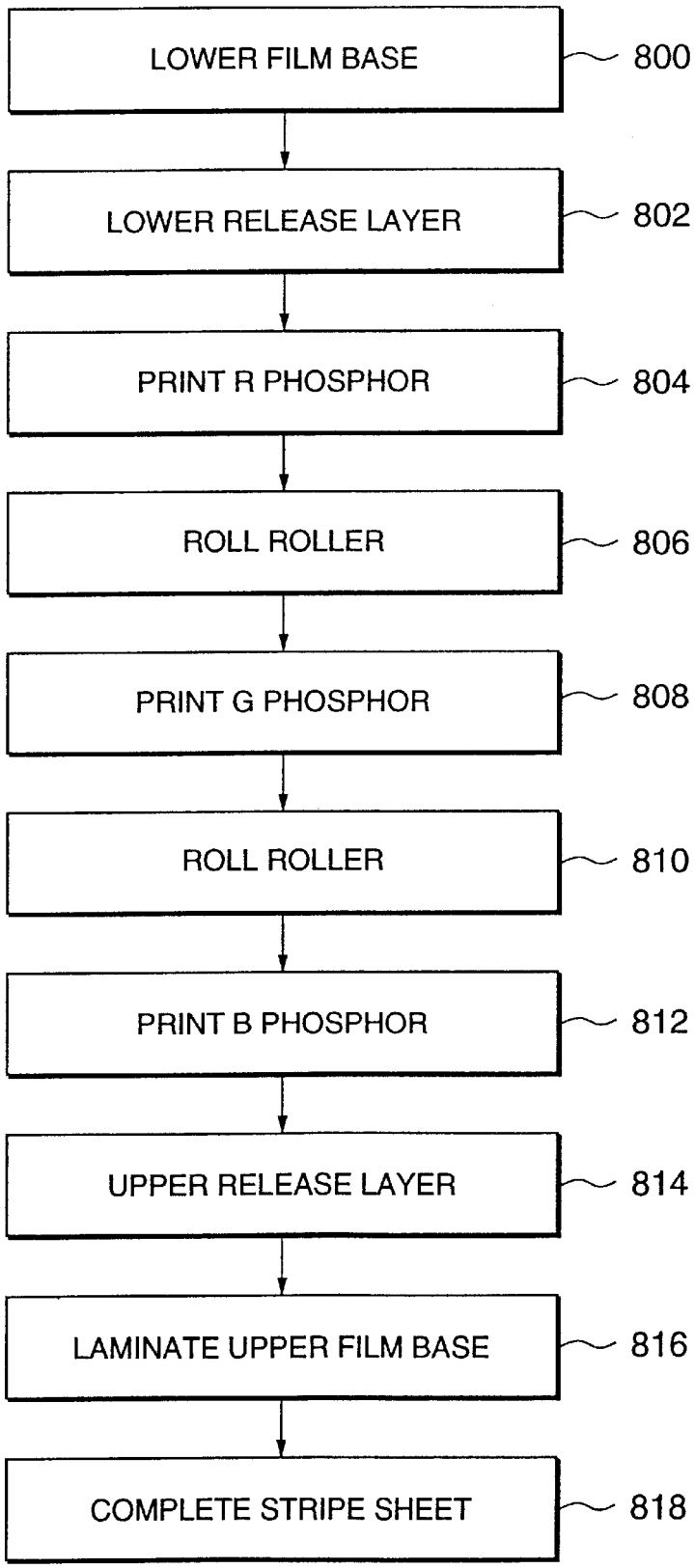
FIG. 25 is a flowchart showing a method of forming a phosphor material sheet according to an eleventh embodiment of the present invention.

FIG. 25 is a flowchart of a method of forming a sheet made of the phosphor material. FIGS. 26A to 26K are cross-sectional views for explaining processing steps. In place of forming the phosphor material layers 200 and 210 on the surface of the rib material layer 50 by the printing in the tenth embodiment, the sheet is laminated on the whole surface of the rib material layer 50.

Figure 26A:
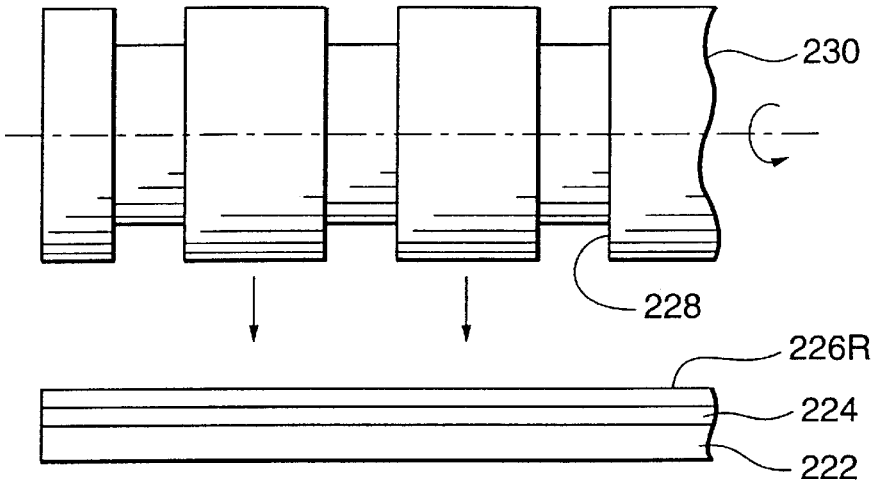
FIGS. 26A to 26K are cross-sectional views for explaining manufacturing processing steps of the phosphor material sheet according to the eleventh embodiment of the present invention and a using method thereof.
Figure 26B:
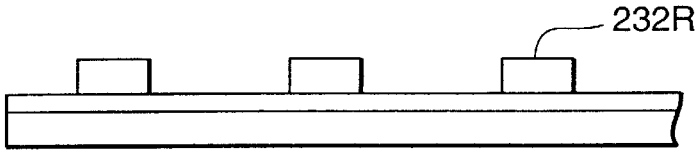

A sheet 220 is manufactured as follows. First, a lower support film base 222 is prepared (step 800 in FIG. 25) and a release agent layer 224 is applied thereto (step 802). On the resultant surface, a first color, for example, read (R) phosphor material paste 226R is solid-printed at a uniform thickness (FIG. 26A, step 804). A roller 230 on which slits 228 each corresponding to a position to be coated with the R phosphor material are formed is rolled on the phosphor material paste 226R (step 806). As a result, the phosphor material paste 226R is gathered to the slits 228 to form embossed portions 232R (FIG. 26B).

Figure 26C:
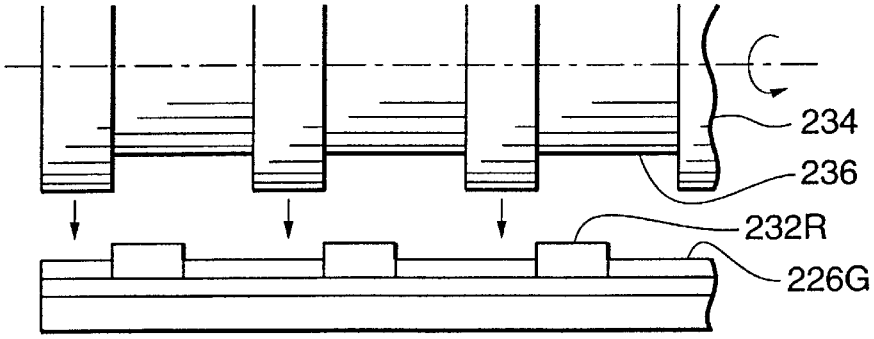
Figure 26D:
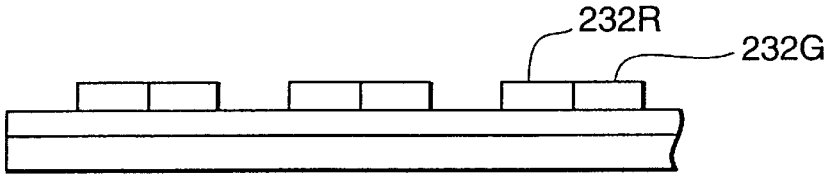

Subsequently, a second color, for example, G (green) phosphor material paste 226G is applied to the surface except the embossed portions 232R by the printing (step 808) and a roller 234 is rolled (step 810). On the surface of the roller 234, slits 236 covering the area of the R embossed portions 232R and G paste applying positions are formed. Rolling the roller 234 allows the G paste 226G to gather into the slits 236 (FIG. 26C). Consequently, G embossed portions 232G are formed next to the R embossed portions 232R (FIG. 26D).

Figure 26E:
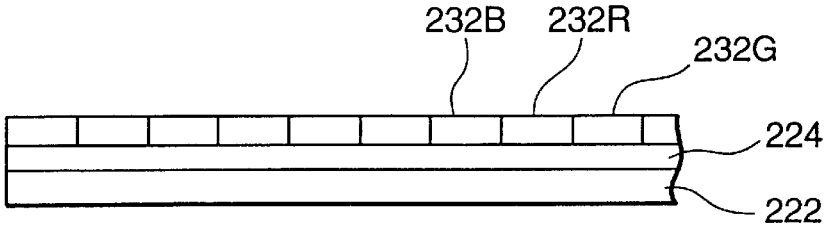
Figure 26F:
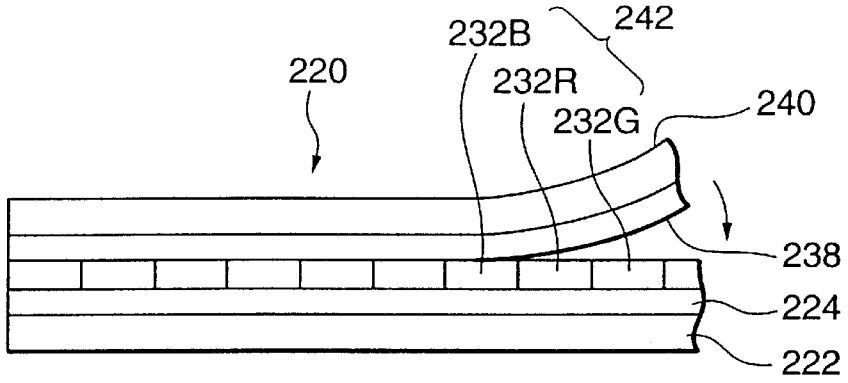
Figure 26G:
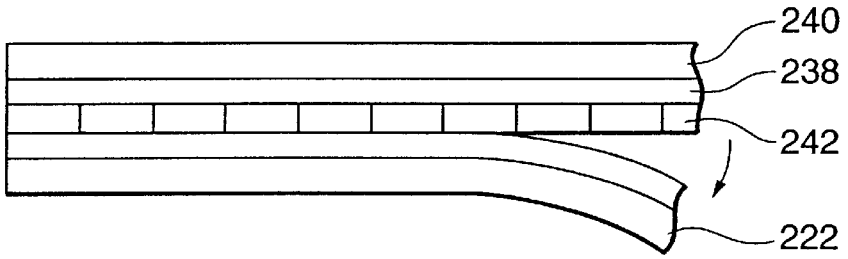

A phosphor material paste 226B of B (blue) as a third color is printed to corresponding positions (step 812). The upper surface of the under release layer 224 is covered with the embossed portions (232R, 232G, 232B) made of the phosphor material pastes (226R, 226G, 226B) (FIG. 26E). After an upper release layer 238 is formed on the resultant surface (step 814), an upper support film base 240 is laminated on the layer (FIG. 26F, step 816). The upper film base 240 can also be laminated after the upper release layer 238 is applied to the upper support film base 240 side. In this manner, the sheet 220 made of the three phosphor materials, which is formed by sandwiching the embossed portions (232R, 232G, 232B) made of the phosphor material pastes (226R, 226G, 226B) arranged in a stripe form between the upper and lower support film base 240, 222. Thus, the stripe sheet is obtained (step 818).

Figure 26H:
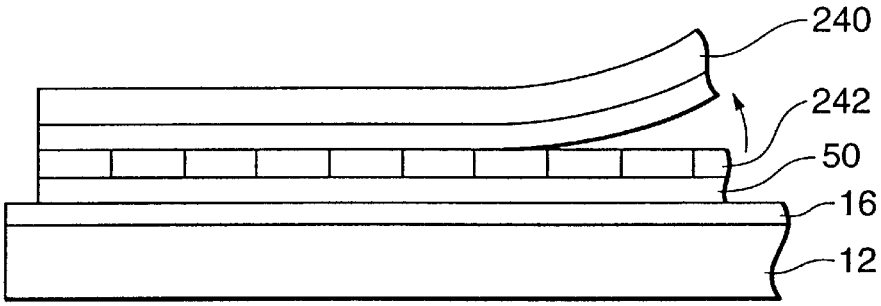
Figure 26I:
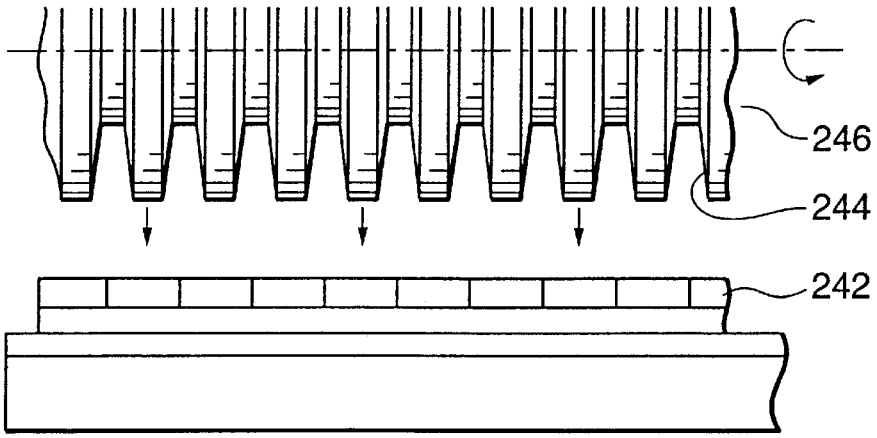

When the sheet 220 is used, the lower film base 222 is peeled off (FIG. 26G) and the sheet 220 is laminated on the rib material layer 50 formed on the glass substrate 12 (FIG. 26H). After that, the upper support film 240 is peeled off. When the rollers 230 and 234 are rolled (steps 806 and 810), ordinarily, it is impossible to prevent the first and second color (R, G) phosphor material pastes 226R and 226G from slightly remaining on the surface except the portions corresponding to the slits 228 and 236. Consequently, the phosphor material pastes 226R, 226G, and 226B are slightly remained and mixed on the lower film base 222. Since the lower film base 222 is peeled off, however, the mixed phosphor material pastes 226R, 226G, and 226B are adhered to the lower film base 222 to be removed together with the film base 222.

Figure 26J:
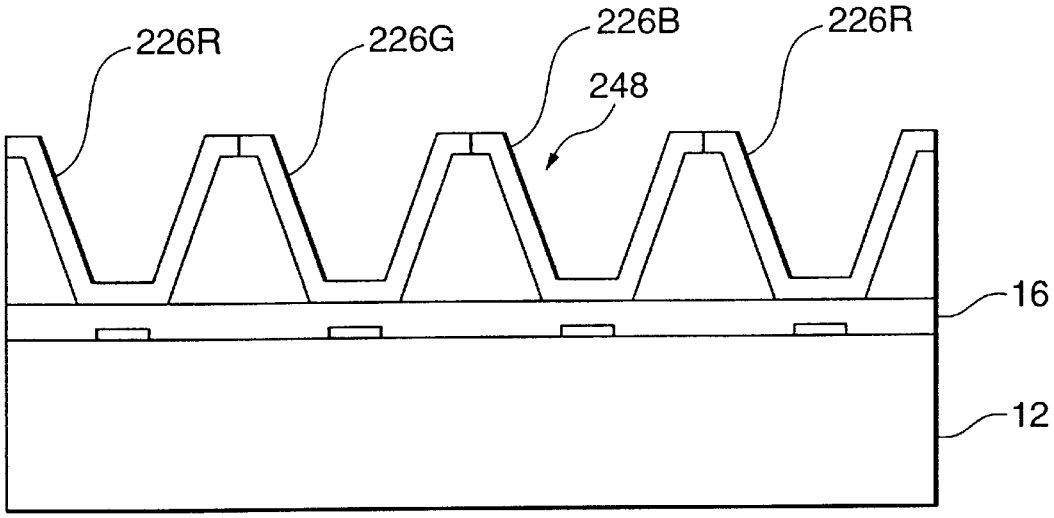
Figure 26K:
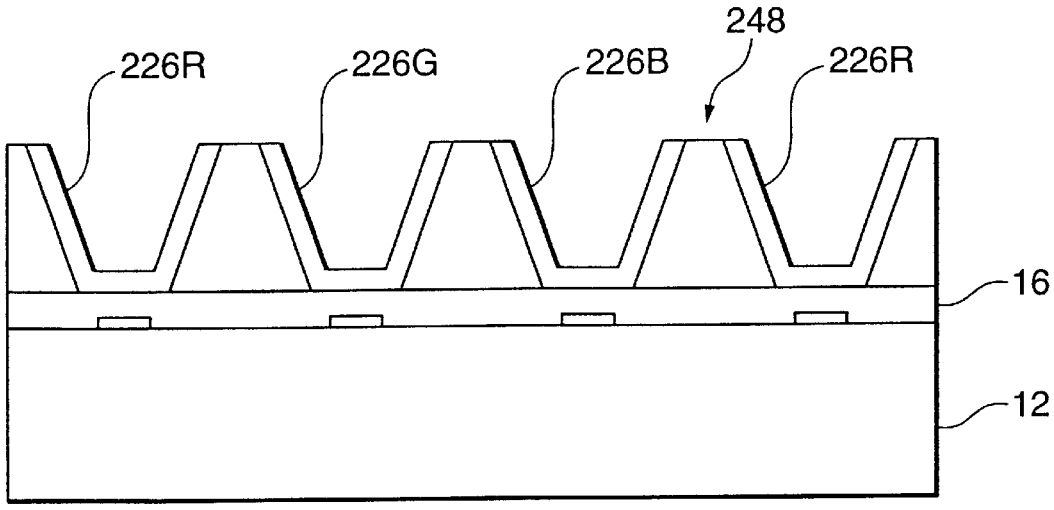

A roller 246 in which slits 244 corresponding to the barrier ribs are formed on the surface is rolled on a phosphor material layer 242 which has been laminated on the rib material layer 50 as mentioned above (FIG. 26I). The rib material layer 50 and phosphor material layer 242 are gathered to the slits 244 to form embossed lines or banks 248 as shown in FIG. 26J. The embossed banks (pre-ribs) and the grooves therebetween are covered with the phosphor material pastes 226R, 226G, and 226B. The phosphor material paste remaining on the top faces of the embossed banks 248 can be cut off prior to or subsequent to drying and firing operation. Accordingly, the phosphor can be removed from the top face of each embossed pre-ribs 248 as shown in FIG. 26K.

What is claimed is:

1. A method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) exposing the barrier rib material layer to a vapor atmosphere of a solvent of the barrier rib material for a predetermined period of time so as to adjust the hardness of the barrier rib material;

(c) rolling a roller, which has an intaglio recessed pattern corresponding to a desired pattern for the barrier ribs, on said barrier rib material layer so that the recessed pattern contacts and embosses the barrier rib material layer to form freestanding structures corresponding to the recessed pattern; and (d) drying and firing a barrier rib material shaped into the freestanding structures, whereby the barrier ribs for partitioning discharge cells are formed on the glass substrate.

2. The method according to claim 1, subsequent to the step (b), further comprising a sub-step of:

(b-1) coating the surface of the barrier rib material layer with a release agent.

3. The method according to claim 1, wherein in the step (a), said barrier rib material layer is formed by laminating a green sheet comprising a glass paste on the glass substrate.

4. The method according to claim 1, wherein in the step (a), said barrier rib material layer is formed by applying a glass paste to the glass substrate and drying the glass plate.

5. The method according to claim 1, wherein said barrier ribs are formed on the glass substrate on the rear surface side of the plasma display panel.

6. The method according to claim 1, wherein said electrodes are formed in a stripe shape in the glass substrate and said roller has a plurality of annular grooves surrounding the peripheral surface of said roller so that stripe-shaped parallel barrier ribs are formed on the glass substrate.

7. The method according to claim 6, wherein said roller comprises two different discs having different outer diameters alternately adhered in the axial direction and fixed.

8. The method according to claim 6, wherein said roller is rolled so that the annular grooves are fitted into portions between the stripe-shaped electrodes.

9. The method according to claim 6, wherein said roller is rolled on the barrier rib material layer so that the annular grooves are arranged in the direction perpendicular to the stripe-shaped electrodes.

10. The method according to claim 1, wherein said roller has grooves in the circumferential direction and the axial direction, which cross each other, on its peripheral surface and said roller is rolled on the barrier rib material layer to form crisscrossing barrier ribs.

11. The method according to claim 1, wherein in the step (c), said roller is relatively moved reciprocatingly on said barrier rib material layer in the same path while its peripheral velocity is being allowed to coincide with the relative linear moving speed of the glass substrate.

12. The method according to claim 1, wherein the applying pressure of said roller to the glass substrate is set to 20 to 200 kg/cm by setting a contact width of the roller in the axial direction as a reference.

13. The method according to claim 1, wherein the diameter of said roller is set to 30 to 500 mm.

14. The method according to claim 1, wherein the relative moving speed of the glass substrate to the roller and the relative peripheral velocity of the roller to the glass substrate are set to 0.02 to 2.0 m/min.

15. The method according to claim 1, wherein the opening and bottom widths and depth of the groove of the roller and a pitch of the grooves have a relationship satisfying the following expressions;

$$0<W_B/W_T<1.0$$

$$0.1<H/W_T<3.0$$

$$0.1(W_T+W_B)2L_P<1.0$$

wherein $W_T$ is the opening width of the groove, $W_B$ is the bottom width of the groove, H is the depth of the groover and $L_P$ is the pitch of the grooves.

16. A method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) forming on said barrier rib material layer a black mask having a pattern corresponding to a desired pattern of the barrier ribs to be formed;

(c) rolling a roller, which has grooves corresponding to the desired pattern of the barrier ribs, on said barrier rib material layer while maintaining each groove over a respective black mask so that a protruding portion between the grooves contacts and embosses the barrier rib material layer to form freestanding structures having the black mask on the top thereof; and (d) drying and firing the barrier rib material shaped into the freestanding structure to form the barrier ribs having the black mask on the top thereof.

17. The method according to claim 16, wherein in the step (b), said black mask is formed by screen printing.

18. The method according to claim 16, wherein in the step (b), said black mask is formed by laminating a sheet, Which is composed of a white rib material layer and a black rib material, on the barrier rib material layer, the white rib material layer forming said barrier rib material layer and the black rib material being patterned to be arranged on positions corresponding to the desired pattern of the barrier rib.

19. A method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) uniformly coating the surface of said barrier rib material layer with a photosensitive black rib material;

(c) rolling a roller, which has an intaglio recessed pattern corresponding to a desired pattern for the barrier ribs, on said barrier rib material layer coated with said photosensitive black rib material so that the recessed pattern forms freestanding structures corresponding the barrier ribs on the glass substrate;

(d) partially removing the black rib material so as to leave it on the upper surfaces alone of the freestanding structures by a technique of photolithography; and (e) drying and firing a barrier rib material with the black rib material shaped into the freestanding structures to form the barrier ribs.

20. The method according to claim 19, wherein said roller comprises two different discs having different outer diameters alternately adhered in the axial direction and fixed.

21. A method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) rolling a roller, which has an intaglio recessed pattern corresponding to a desired pattern for the barrier ribs, on said barrier rib material layer so that the recessed pattern contacts and embosses the barrier rib material layer to form freestanding structures corresponding to the recessed pattern; and (c) drying and firing a barrier rib material shaped into the freestanding structures, whereby the barrier ribs for partitioning discharge cells are formed on the glass substrate;

wherein in the step (a), said barrier rib material layer is formed by applying a glass paste to the glass substrate and drying the glass plate.

22. A method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) rolling a roller, which has an intaglio recessed pattern corresponding to a desired pattern for the barrier ribs, on said barrier rib material layer so that the recessed pattern contacts and embosses the barrier rib material layer to form freestanding structures corresponding to the recessed pattern; and (c) drying and firing a barrier rib material shaped into the freestanding structures, whereby the barrier ribs for partitioning discharge cells are formed on the glass substrate;

wherein in the step (b), said roller is relatively moved reciprocatingly on said barrier rib material layer in the same path while its peripheral velocity is being allowed to coincide with the relative linear moving speed of the glass substrate.

23. A method of forming discharge cells for a plasma display panel having a plurality of discharge cells intervening between a pair of glass substrates formed with electrodes, the discharge cells being partitioned by barrier ribs, said method comprising the steps of:

(a) forming an uncured barrier rib material layer having flexibility on the surface of at least one of said glass substrates, on which said electrodes are formed;

(b) rolling a rib forming roller, which has an intaglio recessed pattern corresponding to a desired pattern for the barrier ribs to be formed, on said barrier rib material layer while the peripheral velocity of the rib forming roller is made to coincide with the relative linear moving speed of the glass substrate, so that the recessed pattern embosses the barrier rib material layer to form freestanding structures corresponding to the barrier ribs on the glass substrate;

(c) drying and firing a barrier rib material shaped into the freestanding structures to form the barrier ribs;

(d) laminating a phosphor material sheet, which is formed by uniformly applying a phosphor material to one side of a film base, on the glass substrate so that said phosphor contacts with the barrier ribs formed in the step (c);

(e) rolling a phosphor filling roller, which has protruding portions corresponding to the positions of the discharge cells to be formed, on the phosphor material sheet laminated in the step (d) to fill said phosphor into the discharge cells between the adjacent barrier ribs;

(f) peeling the film base from the phosphor material sheet;

(g) removing the excess phosphor which is not supplied to the discharge cells in the step (e) and remained on the top faces of the barrier ribs; and (h) firing the phosphor filled in the discharge cells.

24. The method according to claim 23, wherein a plurality of different color phosphor material sheets are used and the steps (d) to (g) are repeated by using the sheets.

25. The method according to claim 24, wherein, in the step (e), said phosphor filling roller is used for each of the different color phosphor material sheets by deviating in the axial direction of the roller only by one or plural pitches in the width direction of the discharge cell.

26. The method according to claim 23, wherein in the step (g), the surface of the substrate on which the barrier ribs are formed is set downwardly and a knife edge is moved along the top face of each barrier rib to scrape off the excess phosphor.

27. The method according to claim 23, further comprising, subsequent to the step (d), a sub-step of:

(d-2) leaving the glass substrate in a vapor atmosphere of a solvent of the phosphor for a predetermined period of time to adjust the hardness of the phosphor.

28. The method according to claim 23, wherein the rollers in the steps (b) and (e), respectively, passes the same path while the peripheral velocity is being allowed to coincide with the relative linear moving speed of the glass substrate to be relatively moved reciprocatingly.

29. The method according to claim 23, wherein the diameter of the phosphor filling roller which is used in the step (e) is set to 30 to 300 mm.

30. The method according to claim 23, wherein the peripheral velocity of the phosphor filling roller is set to 0.05 to 2.0 m/min.

31. A method of forming discharge cells for a plasma display panel having a plurality of discharge cells intervening between a pair of glass substrates formed with electrodes, the discharge cells being partitioned by barrier ribs, said method comprising the steps of:

(a) forming an uncured barrier rib material layer having flexibility on the surface of at least one of said glass substrates, on which said electrodes are formed;

(b) rolling a rib forming roller, which has a peripheral surface provided with grooves corresponding to the barrier ribs to be formed, on said barrier rib material layer while its peripheral velocity is allowed to coincide with the relative linear moving speed of the glass substrate so that the grooves emboss the barrier rib material layer to form freestanding structures corresponding to the barrier ribs on the glass substrate;

(c) drying and firing a barrier rib material shaped into the freestanding structures in the step (b) to form the barrier ribs partitioning the discharge cells;

(d) superposing a screen mask on the glass substrate and supplying a predetermined color phosphor material paste to the positions of the predetermined discharge cells by screen printing;

(e) drying the phosphor material paste supplied in the step (d);

(f) rolling a phosphor filling roller, which has grooves at the same pitches as those of the rib forming roller used in the step (c), on the phosphor material paste to extrude said paste between the grooves and into the discharge cells;

(g) removing the excess phosphor material paste remaining on the top face of each barrier rib; and (h) firing the phosphor material paste in the discharge cells.

32. The method according to claim 31, further comprising, subsequent to the step (e), sub-steps of:

(e-1) leaving the phosphor material paste in a vapor atmosphere of a solvent of the phosphor material paste to adjust the hardness of the phosphor material paste dried in the step (e); and (e-2) applying a release agent to the phosphor material paste with the hardness adjusted in the step (e-1).

33. The method according to claim 31, wherein the phosphor filling roller which is used in the step (f) is used as the rib forming roller in the step (b).

34. The method according to claim 31, wherein a plurality of different color phosphor material pastes are used and the steps (d) to (e) are repeated every color phosphor material paste.

35. The method according to claim 31, wherein the supply amount of the phosphor material paste to be supplied in the step (d) is set so as to exceed the necessary amount for the discharge cells and the excess phosphor material paste is allowed to overflow from the discharge cells by rolling the phosphor filling roller in the step (f).

36. The method according to claim 31, wherein the step (g) comprising scraping off the phosphor material paste overflown on the top face of each barrier rib by a knife edge.

37. A method of forming discharge cells for a plasma display panel having a plurality of discharge cells intervening between a pair of glass substrates on which electrodes are formed, the discharge cells being partitioned by barrier ribs, a phosphor material layer being formed in the internal surface of each discharged cell, comprising the steps of:

(a) forming an uncured barrier rib material layer having flexibility on the surface of at least one of said glass substrates, on which said electrodes are formed;

(b) forming on the barrier rib material layer a phosphor material layer in which phosphor materials are arranged at pitches equivalent to those of the discharge cells to be formed;

(c) rolling a roller, which has an intaglio recessed pattern corresponding to a desired pattern for the barrier ribs to be formed, on said phosphor material layer and barrier rib material layer so that the recessed pattern forms freestanding structures corresponding to the barrier ribs on the glass substrate and fills the phosphor material in spaces between the adjacent freestanding structures; and (d) drying and firing a barrier rib material shaped into the freestanding structures and the phosphor material between the freestanding structures, whereby the discharge cells partitioned by the barrier ribs and having the phosphor material layer on the internal surface are formed.

38. The method according to claim 37, further comprising, subsequent to the step (b), a sub-step of:

(b-1) coating the top surface of the phosphor material layer with a release agent.

39. The method according to claim 38, further comprising, subsequent to the step (b-1), a sub-step of:

(b-3) leaving the glass substrate in a vapor atmosphere of a solvent of the barrier rib material and phosphor material for a predetermined period of time to adjust the hardness of each of the barrier rib material and the phosphor material.

40. The method according to claim 38, wherein the diameter of the roller is set to 30 to 500 mm.

41. The method according to claim 37, further comprising, subsequent to the step (b), a sub-step of:

(b-2) leaving the glass substrate in a vapor atmosphere of a solvent of the barrier rib material and phosphor material for a predetermined period of time to adjust the hardness of each of the barrier rib material and the phosphor material.

42. The method according to claim 37, wherein said barrier rib material layer in the step (a) is formed by applying a glass paste to the glass substrate and drying the glass paste.

43. The method according to claim 37, wherein the barrier ribs are formed on the rear glass substrate of the plasma display panel.

44. The method according to claim 37, wherein the electrodes are formed in a stripe shape in the glass substrate and said roller has a plurality of annular grooves surrounding the peripheral surface of said roller so that stripe-shaped parallel barrier ribs are formed on the glass substrate.

45. The method according to claim 44, wherein said roller is rolled so that the annular grooves are fitted into portions between the stripe-shaped electrodes.

46. The method according to claim 44, wherein said roller is rolled so that the annular grooves are arranged in the direction perpendicular to the stripe-shaped electrodes.

47. The method according to claim 37, wherein said roller has grooves on the peripheral surface in the circumferential direction and the axial direction, which cross each other, and said roller is rolled on the phosphor material layer and the barrier rib material layer to form crisscrossing barrier ribs.

48. The method according to claim 37, wherein in the step (c), said roller is relatively moved reciprocatingly in the same path while the peripheral velocity is being allowed to coincide with the relative linear moving speed of the glass substrate.

49. The method according to claim 37, wherein the applying pressure of the roller to the glass substrate is set to 20 to 200 kg/cm by setting the contact width of the roller in the axial direction as a reference.

50. The method according to claim 37, wherein said barrier rib material layer in the step (a) is formed by laminating a green sheet comprising a glass paste on the glass substrate.

51. The method according to claim 37, wherein the relative moving speed of the glass substrate to the roller and the relative peripheral velocity of the roller to the glass substrate are set to 0.02 to 2.0 m/min.

52. The method according to claim 37, wherein the opening and bottom widths and depth of the groove of the roller and a pitch of the grooves have a relationship satisfying the following expressions;

$$0<W_B/W_T<1.0$$

$$0.1<H/W_T<3.0$$

$$0.1<(W_T+W_B)/2L_P<1.0$$

wherein $W_T$ is the opening width of the groove, $W_B$ is the bottom width of the groove, H is the depth of the groove, and $L_P$ is the pitch of the grooves.

53. The method according to claim 37, further comprising, subsequent to the step (c), a sub-step of:

(c-1) forming a black mask on the phosphor material layer at the position of the upper surface of each barrier rib.

54. The method according to claim 37, wherein the phosphor material layer in the step (b) has a black antireflection material on positions corresponding to the barrier ribs to be formed.

55. The method according to claim 54, wherein said phosphor material layer is formed on the surface of the barrier rib material layer by printing.

56. The method according to claim 37, wherein said phosphor material layer is formed on the surface of the barrier rib material layer by printing.

57. The method according to claim 37, wherein said phosphor material layer is formed by laminating a sheet, which is formed by arranging different color phosphor materials so as to correspond to the discharge cells, respectively, on the barrier rib material layer.

58. The method according to claim 57, wherein said sheet of the phosphor material layer has a black mask pattern corresponding to the pattern of the barrier ribs to be formed.

59. A method of manufacturing a phosphor material sheet which is used to form discharge cells by supplying phosphor to portions between barrier ribs formed on a glass substrate of a plasma display panel, comprising the steps of:

(a) forming a release layer on a lower film base;

(b) printing a first color phosphor to the whole upper surface of said release layer at a uniform thickness;

(c) rolling a first roller on the printed first color phosphor, said first roller having grooves formed on the positions of the discharge cells corresponding to the first color so that said first color phosphor is gathered into the grooves and form first color embossed portions, and drying the formed portions;

(d) printing a second color phosphor to the upper surface of said release layer except said first color embossed portions;

(e) rolling a second roller on the printed second color phosphor, said second roller having grooves formed on the positions of the discharge cells corresponding to the first and second colors so that said second color phosphor is gathered into the grooves of the second roller to form second color embossed portions neighboring the first color embossed portions, and drying the formed portions;

(f) printing a third color phosphor to the upper surface of the release layer except said first and second embossed portions; and (g) laminating an upper film base through the release layer.

60. A method of forming barrier ribs for a plasma display panel having a plurality of discharge cells intervening between a pair of glass substrates formed with electrodes, the discharge cells being partitioned by the barrier ribs, said method comprising the steps of:

(a) forming an uncured barrier rib material layer having flexibility on the surface of at least one of said glass substrates, on which said electrodes are formed;

(b) coating the surface of the barrier rib material layer with a release agent;

(c) exposing the barrier rib material layer to a vapor atmosphere of a solvent of the barrier rib material for a predetermined period of time so as to adjust the hardness of the barrier rib material;

(d) rolling a roller, which has an intaglio recessed pattern corresponding to a desired pattern for the barrier ribs, on said barrier rib material layer so that the recessed pattern contacts and embosses the barrier rib material layer to form freestanding structures corresponding to the recessed pattern; and (e) drying and firing a barrier rib material shaped into the freestanding structures, whereby the barrier ribs for partitioning discharge cells are formed on the glass substrate.

61. The method according to claim 60, wherein in the step (a), said barrier rib material layer is formed by laminating a green sheet comprising a glass paste on the glass substrate.

62. The method according to claim 60, wherein in the step (a), said barrier rib material layer is formed by applying a glass paste to the glass substrate and drying the glass plate.

63. The method according to claim 60, wherein said barrier ribs are formed on the glass substrate on the rear surface side of the plasma display panel.

64. The method according to claim 60, wherein said electrodes are formed in a stripe shape in the glass substrate and said roller has a plurality of annular grooves surrounding the peripheral surface of said roller so that stripe-shaped parallel barrier ribs are formed on the glass substrate.

65. The method according to claim 64, wherein said roller is rolled so that the annular grooves are fitted into portions between the stripe-shaped electrodes.

66. The method according to claim 64, wherein said roller is rolled on the barrier rib material layer so that the annular grooves are arranged in the direction perpendicular to the stripe-shaped electrodes.

67. The method according to claim 60, wherein said roller has grooves in the circumferential direction and the axial direction, which cross each other, on its peripheral surface and said roller is rolled on the barrier rib material layer to form crisscrossing barrier ribs.

68. The method according to claim 64, wherein said roller comprises two different discs having different outer diameters alternately adhered in the axial direction and fixed.

69. The method according to claim 60, wherein in the step (d), said roller is relatively moved reciprocatingly on said barrier rib material layer in the same path while its peripheral velocity is being allowed to coincide with the relative linear moving speed of the glass substrate.

70. The method according to claim 60, wherein the applying pressure of said roller to the glass substrate is set to 20 to 200 kg/cm by setting a contact width of the roller in the axial direction as a reference.

71. The method according to claim 60, wherein the diameter of said roller is set to 30 to 500 mm.

72. The method according to claim 60, wherein the relative moving speed of the glass substrate to the roller and the relative peripheral velocity of the roller to the glass substrate are set to 0.02 to 2.0 m/min.

73. The method according to claim 60, wherein the opening and bottom widths and depth of the groove of the roller and a pitch of the grooves have a relationship satisfying the following expressions;

$$0<W_B/W_T<1.0$$

$$0.1<H/W_T<3.0$$

$$0.1<(W_T+W_B)/2L_P<1.0$$

wherein $W_T$ is the opening width of the groove, $W_B$ is the bottom width of the groove, H is the depth of the groove, and $L_P$ is the pitch of the grooves.

* * * * *